US010712083B1

(12) United States Patent
Choi

(10) Patent No.: US 10,712,083 B1
(45) Date of Patent: Jul. 14, 2020

(54) REFRIGERATOR

(71) Applicant: LG ELECTRONICS INC., Seoul (KR)

(72) Inventor: Seonwoo Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/582,810

(22) Filed: Sep. 25, 2019

(30) Foreign Application Priority Data

Jul. 12, 2019 (KR) ..... 10-2019-0084450

(51) Int. Cl.

| | |
|---|---|
| ***F25D 25/02*** | (2006.01) |
| ***A47B 88/90*** | (2017.01) |
| ***A47B 88/40*** | (2017.01) |
| ***F25D 23/02*** | (2006.01) |

(52) U.S. Cl.
CPC ..... *F25D 25/025* (2013.01); *A47B 88/40* (2017.01); *A47B 88/90* (2017.01); *F25D 23/021* (2013.01); *A47B 2088/901* (2017.01)

(58) Field of Classification Search
CPC ..... F25D 25/025; F25D 23/021; A47B 88/40; A47B 88/90
See application file for complete search history.

(56) References Cited

U.S. PATENT DOCUMENTS

| | | | | |
|---|---|---|---|---|
| 8,282,177 | B1 | 10/2012 | Rotter | |
| 8,376,481 | B2 * | 2/2013 | Lee | F25D 25/025 312/331 |
| 9,377,238 | B2 | 6/2016 | Hall et al. | |
| 9,982,937 | B2 * | 5/2018 | Tierney | A47B 88/493 |
| 2003/0201700 | A1 | 10/2003 | Cho | |
| 2004/0031705 | A1 | 2/2004 | Detemple, II et al. | |
| 2004/0046488 | A1 | 3/2004 | Hogan | |
| 2004/0056573 | A1 | 3/2004 | Chae | |
| 2006/0087208 | A1 | 4/2006 | Oh et al. | |
| 2006/0248916 | A1 | 11/2006 | Kim et al. | |
| 2007/0262686 | A1 * | 11/2007 | Ji | A47B 88/00 312/402 |

(Continued)

FOREIGN PATENT DOCUMENTS

| | | |
|---|---|---|
| CN | 100417900 | 9/2008 |
| CN | 202254607 | 5/2012 |

(Continued)

OTHER PUBLICATIONS

United States Office Action dated Mar. 4, 2020 issued in U.S. Appl. No. 16/582,712.

(Continued)

*Primary Examiner* — Daniel J Rohrhoff
(74) *Attorney, Agent, or Firm* — Ked & Associates, LLP

(57) ABSTRACT

A refrigerator includes a rack gear assembly on a lower surface of a drawer, and the rack gear assembly has a first rack member and a second rack member moved forward sequentially while moving forward such that an opening distance of the drawer is maximized. In addition, a noise reduction part is provided between a stopper member and a confining protrusion part constituting the rack gear assembly. Accordingly, although the stopper member collides with the confining protrusion part, impact noise is reduced and damage caused by the collision is prevented.

20 Claims, 30 Drawing Sheets

(56) References Cited

U.S. PATENT DOCUMENTS

| | | | | |
|---|---|---|---|---|
| 2009/0045713 | A1* | 2/2009 | Kunkle | A47B 88/40 312/402 |
| 2010/0236279 | A1 | 9/2010 | Eom et al. | |
| 2010/0283365 | A1* | 11/2010 | Chen | A47B 88/487 312/334.4 |
| 2011/0050065 | A1* | 3/2011 | Lee | E05B 17/0033 312/402 |
| 2011/0050066 | A1 | 3/2011 | Lee et al. | |
| 2011/0162402 | A1* | 7/2011 | Park | F25D 23/021 62/264 |
| 2012/0091872 | A1* | 4/2012 | Matthes | A47B 88/40 312/334.8 |
| 2012/0125035 | A1* | 5/2012 | Chellappan | F25D 25/025 62/340 |
| 2012/0306338 | A1 | 12/2012 | Nagahata et al. | |
| 2013/0129267 | A1* | 5/2013 | Chen | A47B 88/40 384/20 |
| 2013/0264928 | A1 | 10/2013 | Hong et al. | |
| 2013/0270986 | A1 | 10/2013 | Min et al. | |
| 2013/0270987 | A1* | 10/2013 | Kelly | F25D 25/025 312/331 |
| 2013/0270989 | A1* | 10/2013 | Park | F25D 23/00 312/404 |
| 2014/0265783 | A1* | 9/2014 | Hauer | A47B 88/45 312/331 |
| 2014/0319990 | A1 | 10/2014 | Gephart et al. | |
| 2015/0059398 | A1 | 3/2015 | Yoo et al. | |
| 2015/0184918 | A1 | 7/2015 | Klingshirn et al. | |
| 2016/0146533 | A1 | 5/2016 | Jung | |
| 2016/0153704 | A1 | 6/2016 | Burke et al. | |
| 2016/0178274 | A1 | 6/2016 | Shin | |
| 2016/0320118 | A1 | 11/2016 | Millett | |
| 2016/0370063 | A1 | 12/2016 | Yang | |
| 2017/0051967 | A1* | 2/2017 | Tierney | F25D 25/022 |
| 2017/0336129 | A1 | 11/2017 | Cunningham | |
| 2018/0283771 | A1* | 10/2018 | Shin | F16H 19/04 |
| 2019/0219324 | A1 | 7/2019 | Kang | |

FOREIGN PATENT DOCUMENTS

| | | |
|---|---|---|
| CN | 204902419 | 12/2015 |
| CN | 107388718 | 11/2017 |
| CN | 10-2018-0138085 | 12/2018 |
| CN | 109028726 | 12/2018 |
| CN | 208640001 | 3/2019 |
| CN | 208736030 | 4/2019 |
| CN | 109838961 | 6/2019 |
| DE | 10 2005 016 418 | 3/2006 |
| EP | 2 299 215 | 3/2011 |
| EP | 3 023 721 | 5/2016 |
| EP | 3 505 854 | 7/2019 |
| JP | H04-138337 | 12/1992 |
| JP | H07-275049 | 10/1995 |
| JP | H08-303944 | 11/1996 |
| KR | 10-2006-0027592 | 3/2006 |
| KR | 10-2006-0053420 | 5/2006 |
| KR | 10-2007-0075671 | 7/2007 |
| KR | 10-2008-0101335 | 11/2008 |
| KR | 10-2009-0027111 | 3/2009 |
| KR | 10-2009-0102576 | 9/2009 |
| KR | 10-2009-0102577 | 9/2009 |
| KR | 10-0921380 | 10/2009 |
| KR | 10-2009-0114265 | 11/2009 |
| KR | 10-2010-0012544 | 2/2010 |
| KR | 10-0946784 | 3/2010 |
| KR | 10-2011-0015331 | 2/2011 |
| KR | 20-0460442 | 6/2012 |
| KR | 10-2013-0071919 | 7/2013 |
| KR | 10-2014-0037474 | 3/2014 |
| KR | 10-2018-0138083 | 12/2018 |
| KR | 10-2019-0081331 | 7/2019 |
| WO | WO 2018/051963 | 3/2018 |

OTHER PUBLICATIONS

U.S. Appl. No. 16/583,726, filed Sep. 26, 2019.
U.S. Appl. No. 16/582,647, filed Sep. 25, 2019.
U.S. Appl. No. 16/582,518, filed Sep. 25, 2019.
U.S. Appl. No. 16/582,605, filed Sep. 25, 2019.
U.S. Appl. No. 16/582,712, filed Sep. 25, 2019.
U.S. Appl. No. 16/582,756, filed Sep. 25, 2019.
U.S. Appl. No. 16/582,810, filed Sep. 25, 2019.
U.S. Appl. No. 16/582,668, filed Sep. 25, 2019.
U.S. Appl. No. 16/582,755, filed Sep. 25, 2019.
U.S. Appl. No. 16/582,831, filed Sep. 25, 2019.
U.S. Appl. No. 16/585,284, filed Sep. 27, 2019.
U.S. Appl. No. 16/585,301, filed Sep. 27, 2019.
U.S. Appl. No. 16/585,816, filed Sep. 27, 2019.
European Search Report dated Mar. 23, 2020 issued in EP Application No. 19199602.4.
European Search Report dated Mar. 12, 2020 issued in EP Application No. 19199586.9.
European Search Report dated Mar. 17, 2020 issued in EP Application No. 19199553.9.
European Search Report dated Mar. 20, 2020 issued in EP Application No. 19199569.5.
European Search Report dated Mar. 30, 2020 issued in EP Application No. 19199556.2.
European Search Report dated Apr. 3, 2020 issued in EP Application No. 19199625.5.
European Search Report dated Apr. 6, 2020 issued in EP Application No. 19199629.7.
European Search Report dated Apr. 6, 2020 issued in EP Application No. 19199587.7.
European Search Report dated Apr. 7, 2020 issued in EP Application No. 19199607.3.

* cited by examiner

REFRIGERATOR

CROSS-REFERENCE TO RELATED APPLICATION(S)

The present application claims priority to Korean Patent Application No. 10-2019-0084450, filed in Korea on Jul. 12, 2019, the entire contents of which is incorporated herein for all purposes by this reference.

BACKGROUND

1. Field

The present relates to a refrigerator having a drawer automatically moved forward and backward.

2. Background

A refrigerator is an appliance that includes a cabinet defining an interior storage chamber that is maintained at a relatively cool temperature. For example, the refrigerator may generate cold air to cool the storage chamber by circulation of a refrigerant according to a refrigeration cycle.

The refrigerator may include various types of mechanisms that provide access to the storage chamber via an opening in the cabinet and seal the opening. For example, the refrigerator may include a swinging door and/or a sliding drawer. A hybrid-type refrigerator may include both a door and a drawer. The hybrid-type refrigerator may include, for example, at least one swinging door positioned at an upper portion of the cabinet and a drawer positioned at a lower portion of the cabinet.

The drawer may include a front panel and a storage bin. The front panel may form a portion of a front surface of the refrigerator and may provide a handling surface to receive a user-applied force to slide the drawer in or out of an interior of the cabinet. The storage bin may be provided at a rear of the front panel to be selectively inserted into or removed from the interior of the cabinet based on the user-applied force to the front panel.

A refrigerator may include a drawer that automatically opens or closes. For example, as described in Korean Patent Application Publication Nos. 10-2009-0102577, 10-2009-0102576, 10-2013-0071919, and 10-2018-0138083, a combination of rack and a pinion may be used to automatically apply a force to move a drawer. For example, a guide rack having a rack gear may be provided on opposite inner side wall surfaces of the cabinet, and a pinion may be provided on opposite side wall surfaces or opposite sides of a rear surface of the storage bin to engage the guide racks.

However, an opening distance of the drawer in the conventional refrigerators may be limited due an engagement between the rack and the pinion such that user access to an interior of the storage bin is restricted. Furthermore, one or more walls of the storage bin may be deformed due to a weight of items stored in the storage bin, and this deformation of the storage bin may move a guide rack relative to a pinion such that the pinion may run idly or gear teeth of the pinion and the guide rack do not engage correctly and collide.

Furthermore, the drawer of a conventional refrigerator may have impact noise caused by contact with a structure of preventing the drawer from being excessively moved backward when closing of the drawer. For example, a drawer with the guide rack and the pinion may include a structure preventing an excessive backward movement of the guide rack or allowing the guide rack to be fixed to a predetermined portion.

The above references are incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DETAILED DESCRIPTION

Figure 1:
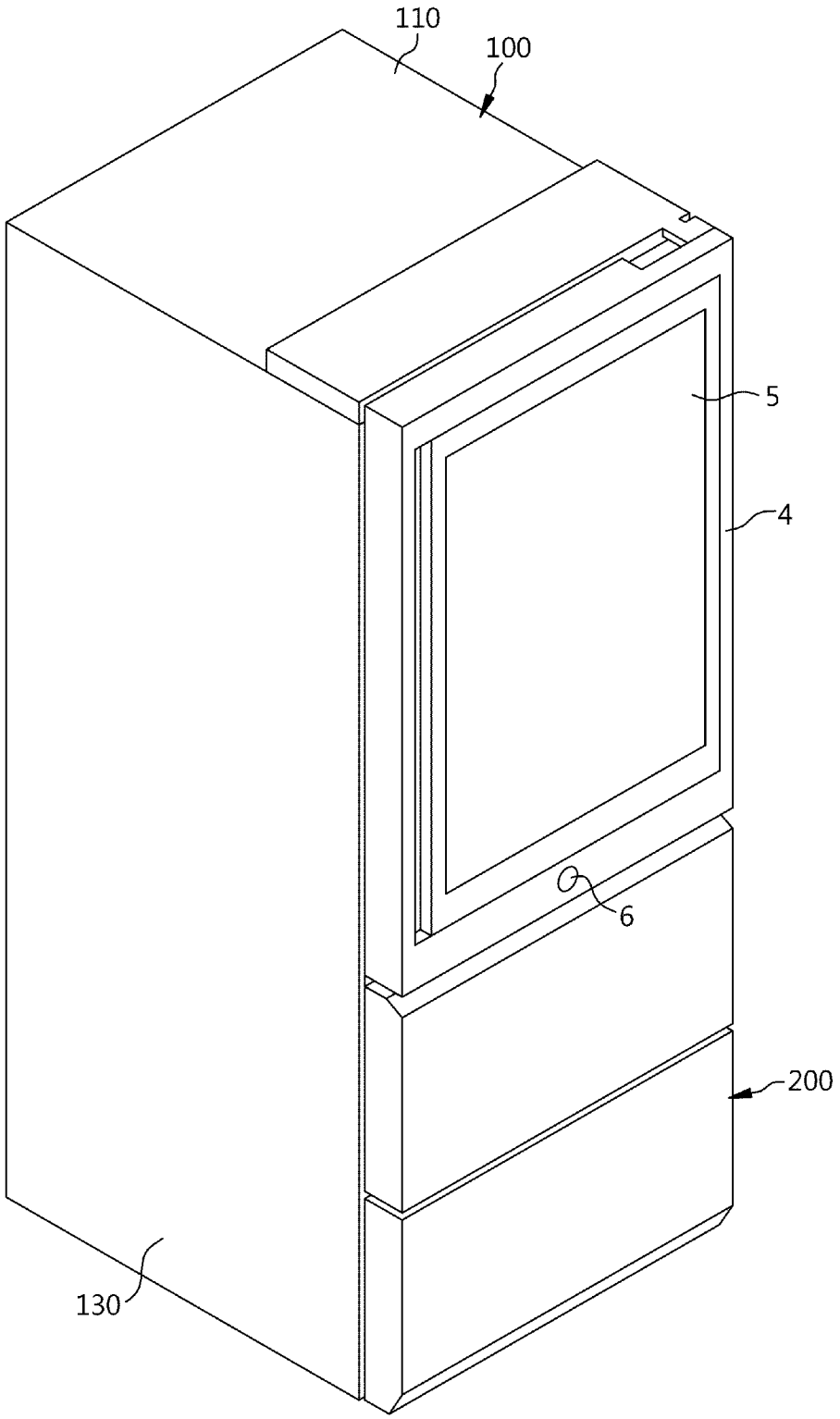
FIG. 1 is a perspective view illustrating the refrigerator according to an embodiment of the present disclosure.

Hereinbelow, a refrigerator is described with reference to FIGS. 1 to 32. As illustrated in the drawings, a refrigerator according to certain embodiments of the present disclosure may include a cabinet 100, a drawer 200, a driving part (or driving module) 400, and one or more rack gear assemblies 600. In certain examples, the rack gear assemblies 600 may extend in multiple steps such that the drawer 200 may be completely moved forward out of a lower storage chamber 3 in the cabinet 100. Impact noise occurring during operation of each of the rack gear assemblies 600 can be reduced by a noise reduction part (or pad) 660 (See FIG. 21).

The cabinet 100 may constitute an outer surface of the refrigerator. The cabinet 100 may include an upper wall or roof 110, a lower wall or bottom 120 constituting, and opposite side walls 130. For example, the cabinet may be configured as a box body, which is opened forward. An inner space of the cabinet 100 may provide a storage space.

In addition, one or more partition walls 140 may be provided in the cabinet 100. The partition walls 140 may be divide the storage space of an inner part of the cabinet 100 into a two or more spaces. In certain implementations, the partition walls 140 may extend vertically to partition the storage space in the cabinet 100 to form, for example, a plurality of storage chambers 1, 2, and 3, which are vertically positioned. This is illustrated in FIG. 3.

In other implementations, the partition walls 140 may extend vertically to partition the storage space in the cabinet 100 into storage chambers that are horizontally positioned.

Figure 2:
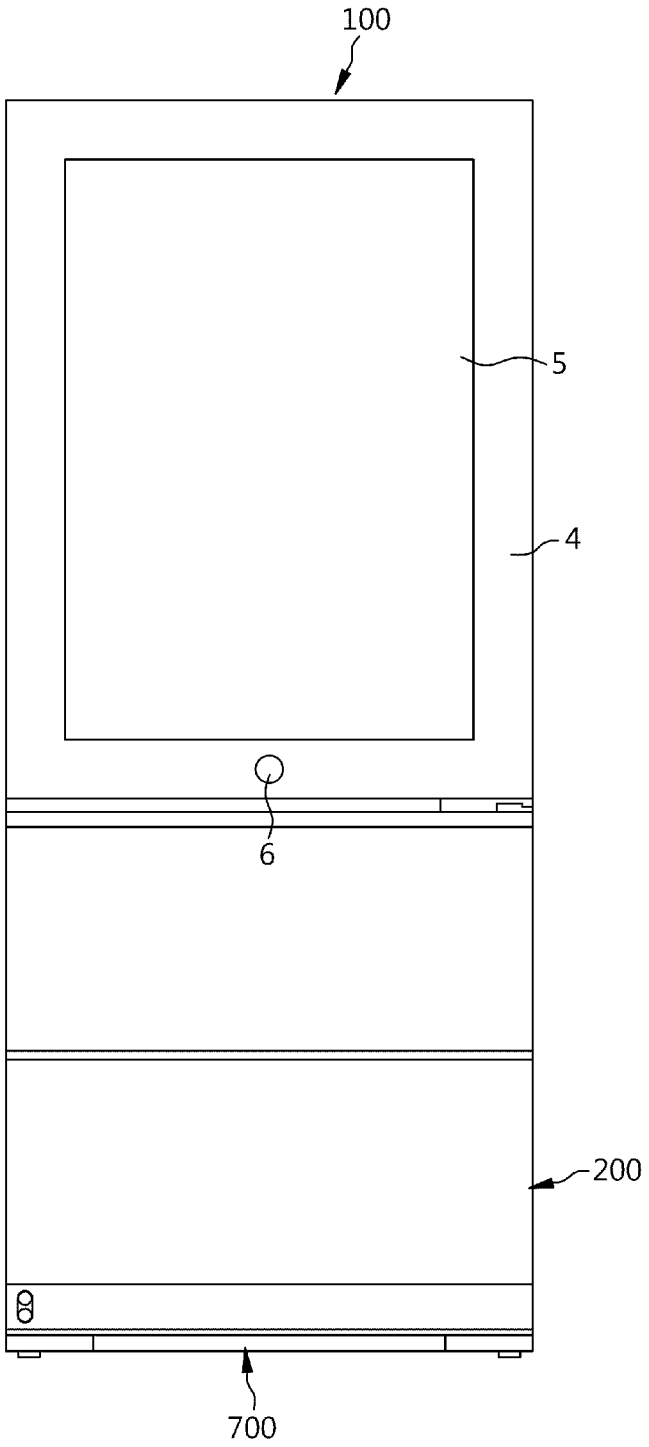
FIG. 2 is a front view illustrating the refrigerator according to the embodiment of the present disclosure.
Figure 3:
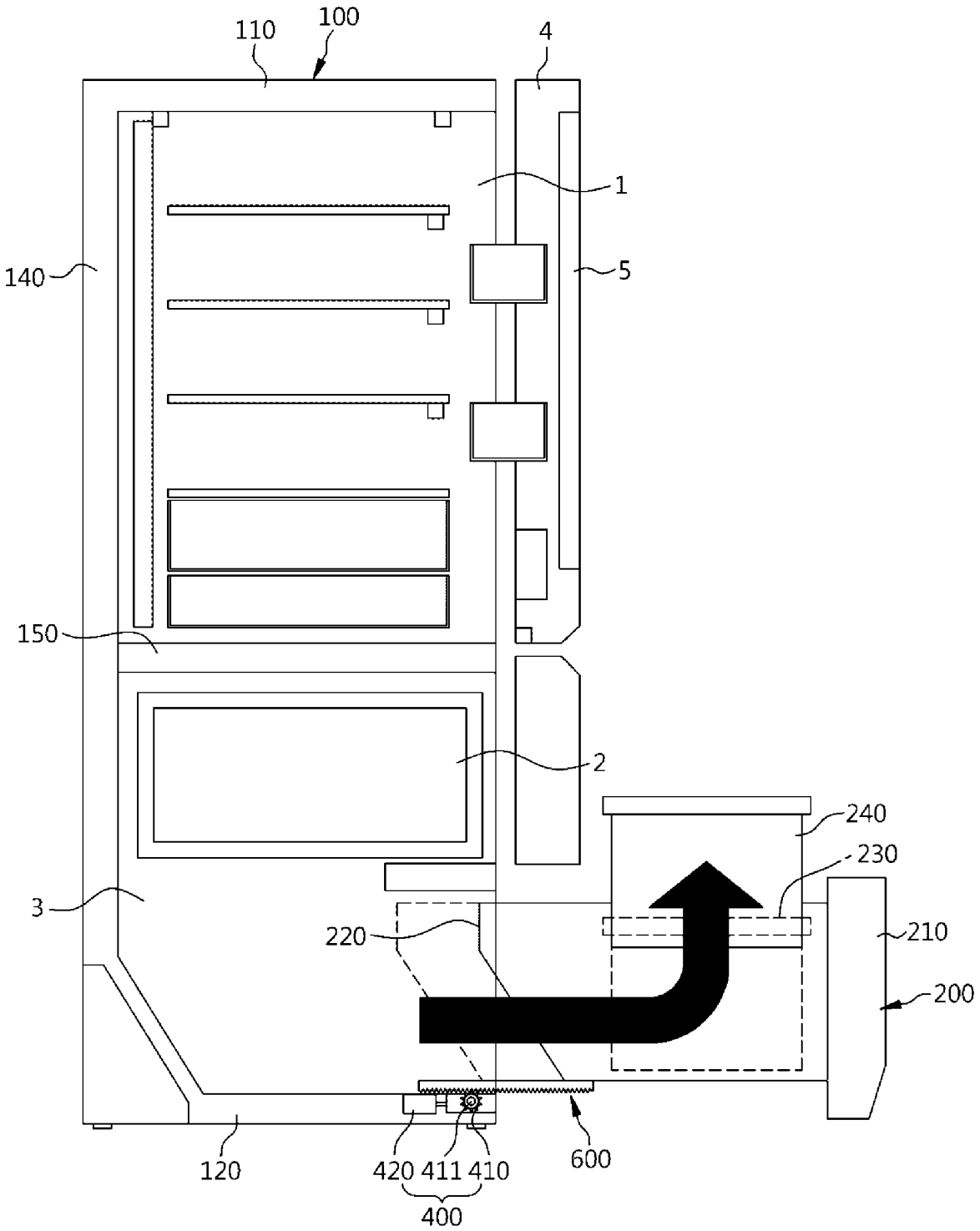
FIG. 3 is a side view illustrating the refrigerator according to the embodiment of the present disclosure.

In the refrigerator according to an embodiment of the present disclosure depicted in FIGS. 1-3, a storage space in the cabinet 100 may be vertically divided into three chambers (e.g., upper storage chamber 1, middle storage chamber 2, and lower storage chamber 3). The storage space may be divided, for example, such that the upper storage chamber 1 may be used as a refrigerating compartment, and the center storage chamber 2 and the lower storage chamber 3 may be used one or more of a refrigerating compartment, a freezer compartment, or as an independent space.

Each storage chamber 1, 2, and 3 of the cabinet 100 may be separately opened and closed. For example, the upper storage chamber 1 may be accessed by a swinging door 4, and the center storage chamber 2 and the lower storage chamber 3 may be accessed by the drawer 200. In another example, the center storage chamber 2 may be configured to be accessed via the swinging door 4.

The swinging door 4 may be hingedly coupled to the cabinet 100, and the swinging door 4 may rotate to open or close an opening to the upper storage chamber 1. In certain examples, a display part (or display) 5 may be provided on a front surface of the swinging door 4 to output information. As used herein, a "front" direction may refer to a direction in which the door 4, the display part 5, and/or the drawer 200 are provided with respect to the cabinet 100. The display part 5 may output visual content, such as information related to an operation state of the refrigerator, temperatures the storage chambers 1, 2, and 3, etc. The display part 5 may include at least one of a liquid crystal display (LCD) screen or a light emitting diode (LED).

The drawer 200 is a structure that slides to open or close an opening in the cabinet 100, and in certain embodiments, the drawer 200 may be provided in the lower storage chamber 3. The drawer 200 may include a front panel 210 and a storage bin 220. In one example, the front panel 210 closes an open front of the lower storage chamber 3 and has an installation space therein. The front panel 210 includes one or more wall surfaces (e.g., an upper surface, opposite side surfaces, a front surface, and a lower surface) that may be formed by bending a thin metal plate, and may include an inner frame of a resin material to reduce weight. In another example, the front panel 210 may be formed of a non-metal material that approximates the feel of metal.

The storage bin 220 may be provided at a rear of the front panel 210 and may be received in the lower storage chamber 3. For example, the storage bin 220 may be configured as a box body, which is open upward. A front surface of the storage bin 220 may be fixed to a rear surface of the front panel 210 while the front surface of the storage bin 220 is in close contact with the rear surface of the front panel 210. The storage bin 220 may be coupled to the front panel 210 using various connectors, such as hooks, bolts, or screws, or the front panel 210 may include one or more sections the engage or otherwise fit against the storage bin.

Guide rails 230 may be provided on opposite outer surfaces of the storage bin 220 and on opposite inner wall surfaces of the inner part of the lower storage chamber 33 to oppose each other such that the guide rails 230 engage each other to support stable forward and backward movements of the storage bin 220. Although not shown in the drawings, one or more guide rails 230 may be provided on each of a lower surface of the storage bin 220 and on an opposing bottom surface of the interior of the lower storage chamber 3 such that the guide rails 230 may engage each other. In addition, the guide rail 230 may be configured to extend in multiple steps.

In addition, a container 240 may be further provided in the storage bin 220. Although various kinds of food may be stored in the storage bin 220, the container 240 may be received into the storage bin 220 such that one or more kinds of food may be stored in the container 240. The container 240 may be, for example, a kimchi container or a container having an open upper part.

When the storage bin 220 is opened from the lower storage chamber 3, the container 240 may be configured to move upward in the storage bin 220. For example, a sufficient gap is provided for a user's finger to enter a gap between the storage bin 220 and the container 240 such that the user can lift the container 240 received in the storage bin 220. Accordingly, a size of the container 240 may decrease to provide sufficient space for the gap between the storage bin 220 and the container 240. Accordingly, to maximize the size of the container 240, the container 240 may be automatically removed from the storage bin 220. For example, the container 240 may be automatically removed from the storage bin 220, such that a withdrawal of the container 240 by the user is not needed.

To automatically removed the container 240 from the storage bin 220, the storage bin 220 may further include a lift module 300 (See FIGS. 4 and 5) that automatically raises and lowers the container 240. The lift module 300 may be implemented in various forms. For example, the lift module 300 may be configured to have a scissor-type link structure such that when the lift module 300 is folded, a height thereof is minimized and when the lift module 300 is spread, the height thereof is maximized.

In addition, electric components 310, such as a driving motor to provide a driving force for lifting and lowering the lift module 300, may be provided in the installation space inside the front panel 210.

If the lift module 300 operates before the storage bin 220 of the drawer 200 is completely opened (e.g., within the cabinet 100), the container 240 and/or the cabinet 100 may be damaged. Accordingly, a controller (not shown) to manage the operation of the lift module 300 may be program to operate only when the storage bin 220 is completely opened.

Figure 4:
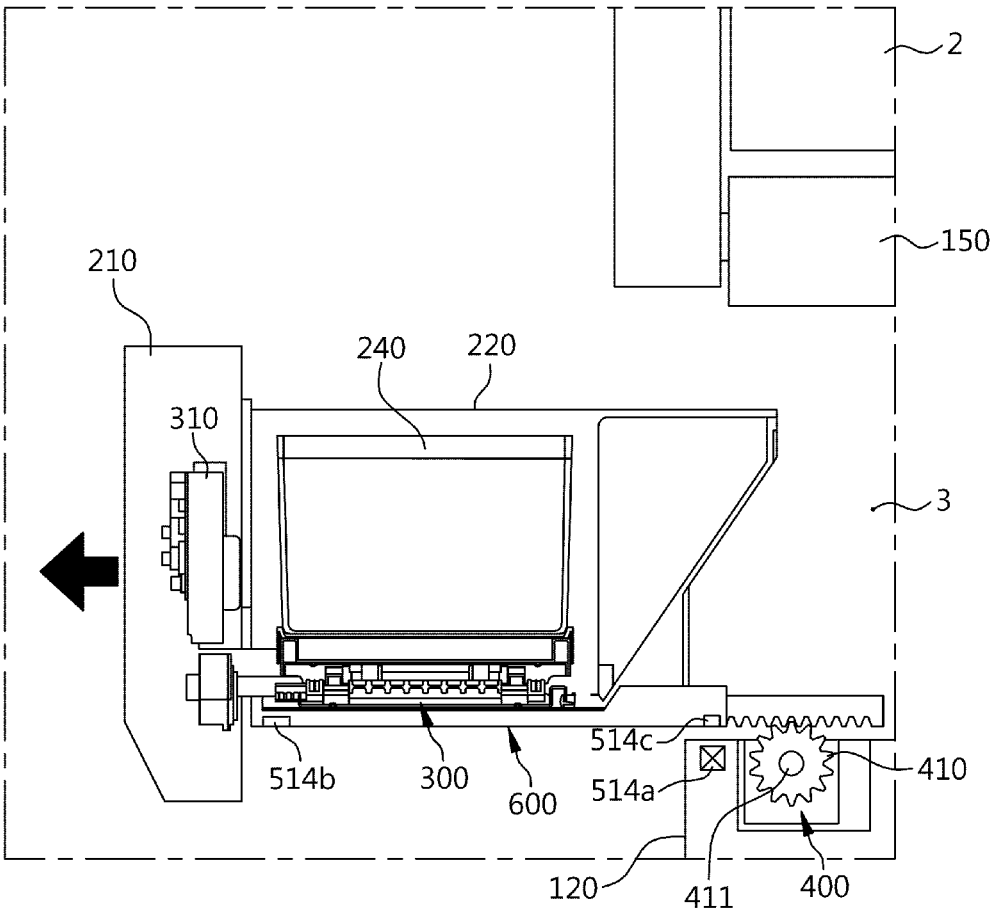
FIG. 4 is a state view of an important part roughly illustrating an opened state of a drawer of the refrigerator according to the embodiment of the present disclosure.
Figure 5:
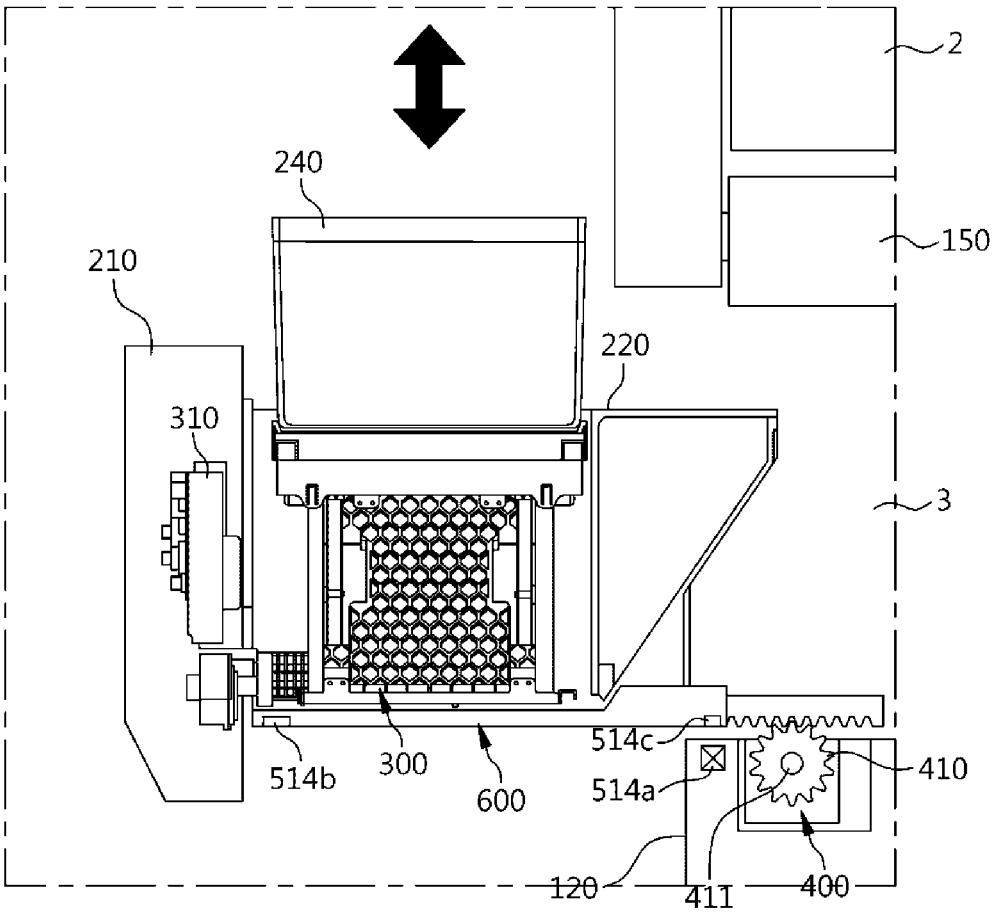
FIG. 5 is a state view of an important part roughly illustrating a state of a container moving upward in the opened state of the drawer of the refrigerator according to the embodiment of the present disclosure.
Figure 6:
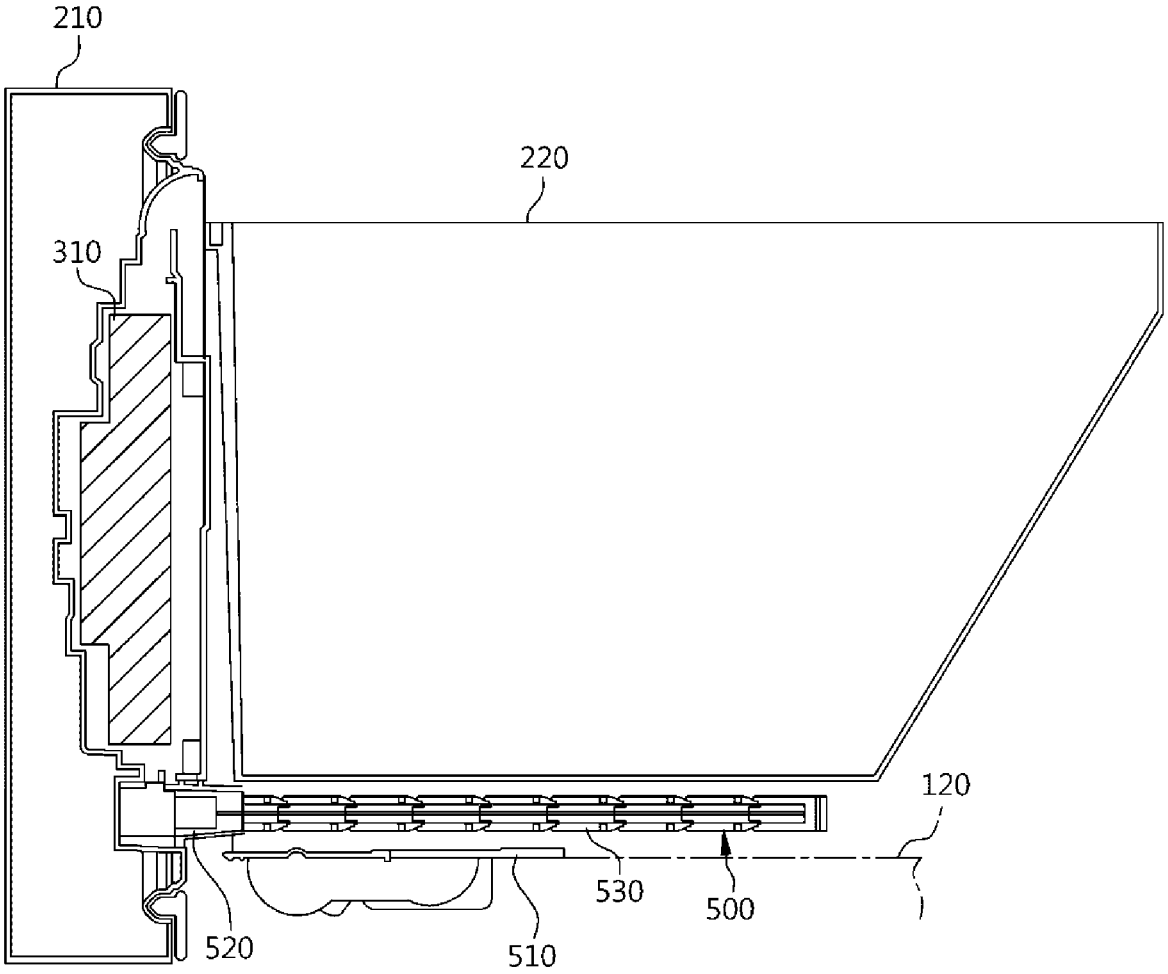
FIG. 6 is a side view illustrating a state of a cable guide module connected to the drawer of the refrigerator according to the embodiment of the present disclosure.

The driving part 400 may provide a driving force to allow the drawer 200 to automatically move forward and backward. As illustrated in FIGS. 3 and 4, the driving part 400 may be positioned at the bottom 120 of the cabinet 100 and may include the pinion 410 and the driving motor 420. In one configuration, the pinion 410 may be positioned to expose at least a portion of the pinion 410 to the inner region of the lower storage chamber 3, such as the pinion 410 being upward formed through a bottom surface of the lower storage chamber 3 (e.g., from an upper surface of the bottom 120 of the cabinet), and the driving motor 420 may be fixed to the bottom 120 of the cabinet 100 so as to transmit power to the pinion 410.

In one embodiment, pinions 410 may be positioned, respectively, on opposite sides of the bottom surface of the interior of the lower storage chamber 3. In this example, each of the pinions 410 may be connected to a power transmission shaft 411, and the driving motor 420 may be connected to the power transmission shaft 411 by a belt, a chain, a gear, etc. to transmit power thereto. In this configuration, each of the pinions 410 may be simultaneously rotated at a same speed and in a same direction by driving force of the driving motor 420. Additional components, such as a reduction gear (not shown), may be further provided at a connection interface of the power transmission shaft 411 and the driving motor 420. In one configuration, the pinions 410 may be preferably positioned at a front side of a bottom surface of the lower storage chamber 3 to allow the drawer 200 to be maximally opened.

The driving motor 420 may be activated to provide a driving force to the power transmission shaft 420 based on detecting a proximity of a user or when a user manipulate a button 6 or other input device on the refrigerator. For example, the button 6 may be a touch-type button provided on the display part 5 of the swinging door 4. In other examples, the button 6 may be a press button provided at a position separate from the display part 5.

A cable guide module (or cable guide) 500 may be connected to the bottom surface (the upper surface of the bottom) of the inner part of the lower storage chamber 3 and the front panel 210. Various kinds of power lines or cables may extend along an inner part of the bottom 120, and the cable guide module 500 may be configured to protect power lines or cables (hereinbelow, referred to as "cable") connected to electrical components in the front panel 210. For example, the cable guide module 500 may be configured to prevent a power cable from being damaged by being twisted or scratched during the forward or backward movement of the drawer 200.

To this end, the cable guide module 500 may include a cover plate 510, a guiding head 520, multiple connecting members (or connecting segments) 530, a swinging connection member (or swinging connection base) 540 and a mounting plate 550, as shown in FIGS. 6 to 10. The cable guide module 500 will be described in greater detail below.

Figure 9:
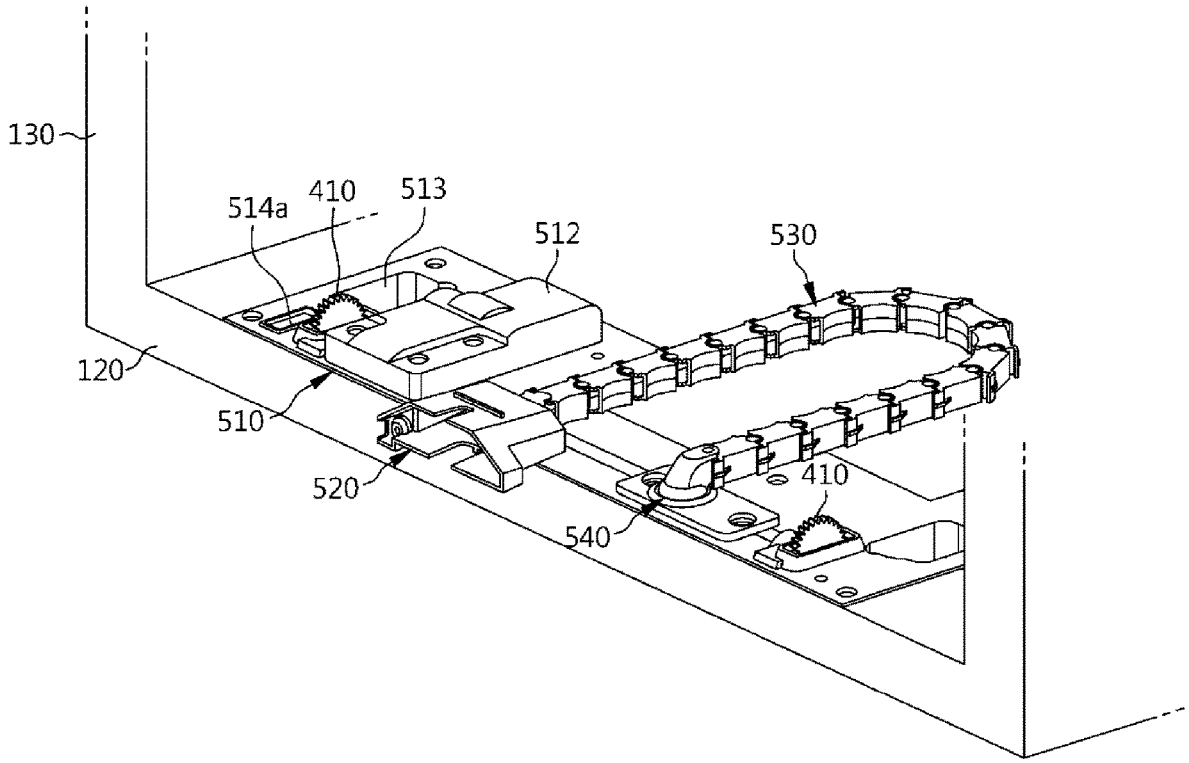
FIG. 9 is a perspective view illustrating a state in which the cable guide module of the refrigerator according to the embodiment of the present disclosure is installed in a storage chamber of the refrigerator.

The cover plate 510 of the cable guide module 500 may be combined with the upper surface of the bottom 120 of the cabinet 100. A front portion of the upper surface of the bottom 120 may be configured to be open, and the cover plate 510 may be combined with the bottom 120 so as to cover the open portion of the bottom 120. This is shown in FIG. 9.

A pinion exposure holes 511 may be provided on opposite sides of the cover plate 510 such that the pinions 410 included in the driving part 400 may be exposed to the interior of the lower storage chamber 3 via the pinion exposure holes 511. (See FIGS. 7 and 8).

In addition, a motor receiving part (or motor mount) 512, into which the driving motor 420 included in the driving part 400 may be received, may be positioned on the cover plate 510. The motor receiving part 512 may be formed, for example, by protruding a portion of the cover plate 510 upward or may be manufactured independently in other method and in other shapes and coupled to the cover plate 510.

In addition, protrusion passing holes (or protrusion receiving hole) 513 may be provided on a rear of opposite sides of the cover plate 510 (see FIG. 10) and may receive a confining protrusion part 650 therein, which will be described later. The confining protrusion part 650 may be positioned so that an upper end thereof is exposed to the inner part of the lower storage chamber 3 while another portion of the confining protrusion part 650 is received in the protrusion passing hole 513. The confining protrusion part 650 will be described with respect to the rack gear assembly 600.

In addition, an open/close sensing part (or sensor) 514*a* may be provided on any one side of the cover plate 510 so as to detect closing and opening of the drawer 200. (See FIGS. 4 and 5). The open/close sensing part 514*a* may be provided as a Hall sensor, and in this case, magnets 514*b* and 514*c*, which can be detected by the Hall sensor, may be provided on the lower surface of the storage bin 220 or the rack gear assembly 600. In other implementations, the open/close sensing part 514 may also include various other structures, such as optical sensors and switches, and a position thereof may also be provided at location on the cabinet 100 and/or the drawer 200

Figure 10:
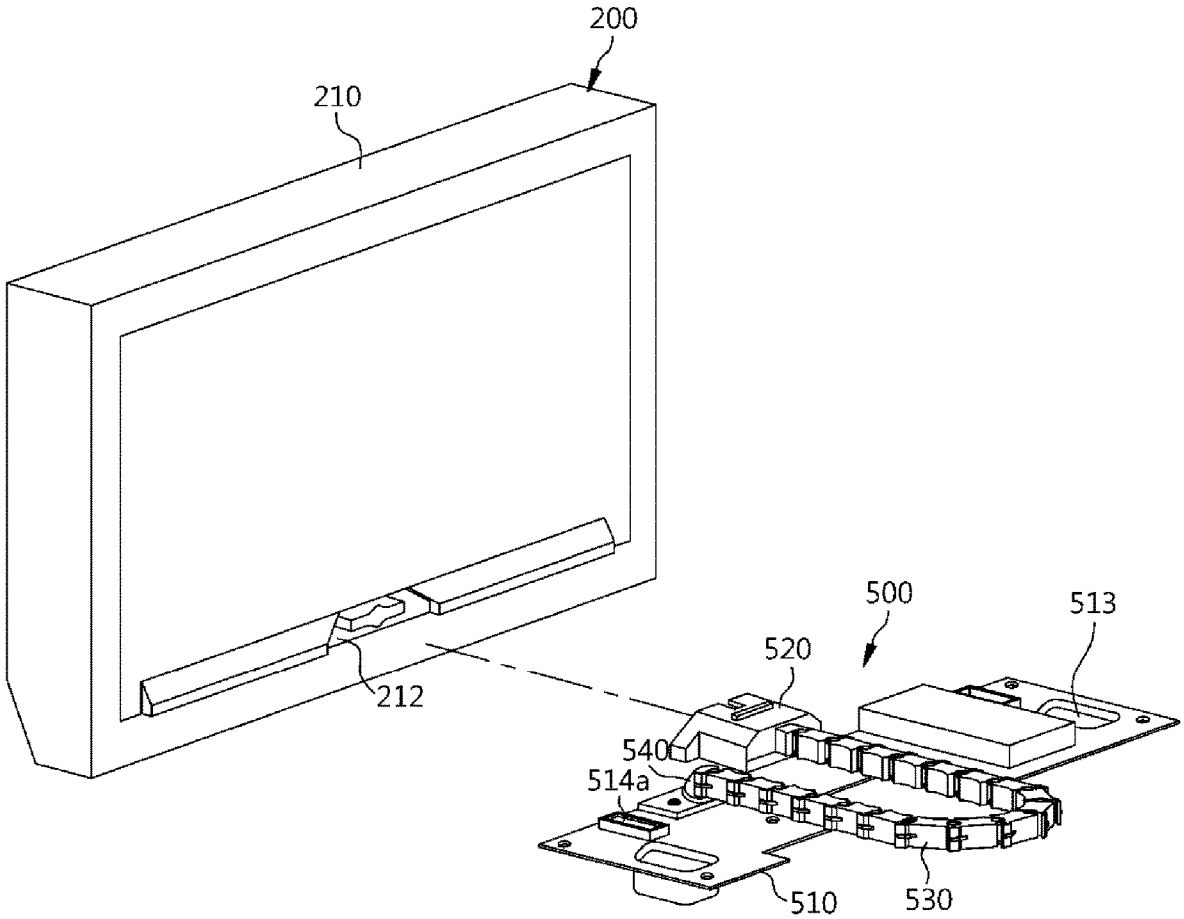
FIG. 10 is a perspective view, from a rear side of the drawer, illustrating a state in which the cable guide module of the refrigerator according to the embodiment of the present disclosure is connected to the drawer.

Next, the guiding head 520 of the cable guide module 500 may be coupled to the front panel 210. For example, an installation hole 212 may be provided on the front panel 210, such at a center lower portion of a rear surface of the front panel 210, and the guiding head 520 may pass through a portion of the installation hole 212 and be coupled to the rear surface or other portion of the front panel 210. This is illustrated in FIG. 10.

The connecting members 530 of the cable guide module 500 may flexibly connect the swinging connection member 540 to the guiding head 520. Each of the connecting members 530 may be configured as a tube body having a substantially hollow inner core and may be continuously connected to each other such that at least one cable may sequentially pass through the inner core of each of the connecting members 530.

In one implementation, the connecting members 530 have a chain-type connection structure. For example, a connection portion between each of the connecting members 530 may be configured to be rotatable in a horizontal direction. A first end of the connecting member 530 may be rotatably connected to the swinging connection member 540, and a second end of the connecting member 530 may be rotatably connected to the guiding head 520. When the drawer 200 moves forward or backward, the connecting members 530 move the cable together therewith by operating in cooperation with each other.

The swinging connection member 540 of the cable guide module 500 may be rotatably connected to the cover plate 510. A cable through hole 515 may be provided in the cover plate 510 so as to allow the cable to pass therethrough, and the swinging connection member 540 may have a pipe structure with an end position in close contact with an upper surface of the cover plate 510 when the swinging connection member 540 is coupled to the cover plate 510.

An extension end 541 having a dome structure may be provided at an end portion of the swinging connection member 540, and the extension end 541 gradually extending toward the end thereof. For example, an extension hole 516 may be provided to extend from a circumference surface of the cable through hole 515, and a confining protrusion 542 may be provided on a circumference of the extension end 541 of the swinging connection member 540 and may pass through the extension hole 516 to couple the swinging connection member 540 to the cover plate. For example, the confining protrusion 542 may protrude radially outward from a circumference surface of the extension end 541.

Figure 7:
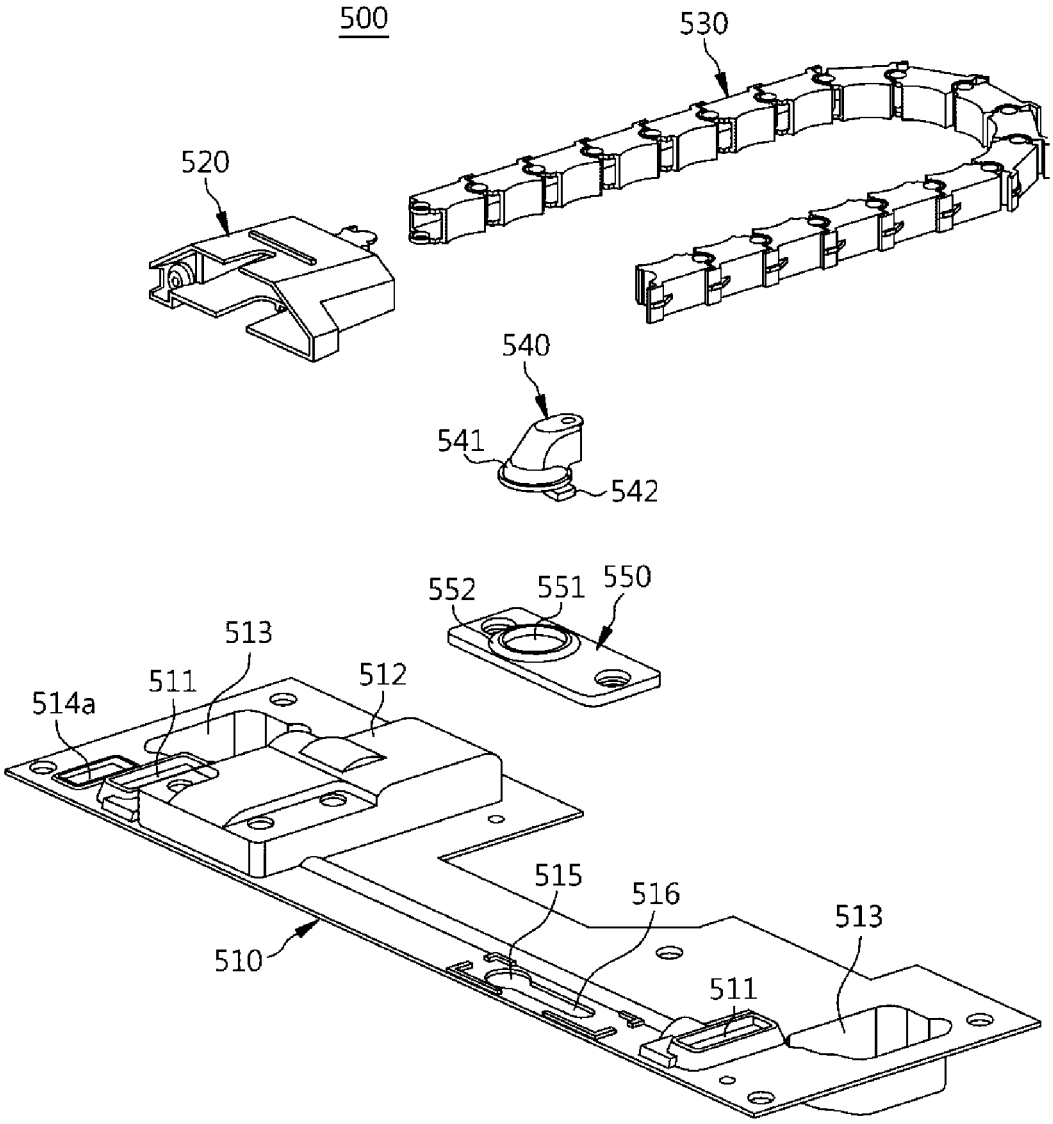
FIG. 7 is an exploded perspective view illustrating the cable guide module of the refrigerator according to the embodiment of the present disclosure.
Figure 8:
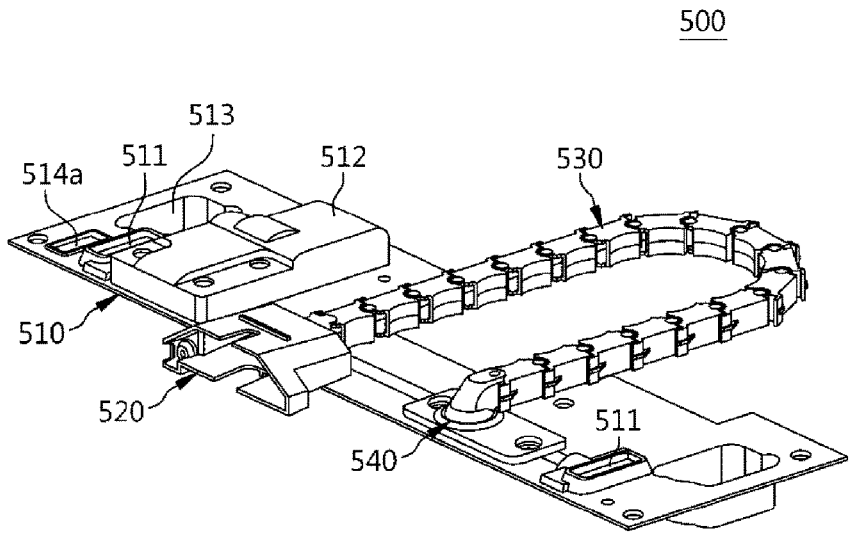
FIG. 8 is an assembled perspective view illustrating the cable guide module of the refrigerator according to the embodiment of the present disclosure.

In this case, the extension hole 516 may be formed to have a sufficiently narrow width to allow the confining protrusion 542 to pass therethrough. After the confining protrusion 542 passes through the extension hole 516, the swinging connection member 540 may be slightly rotated to be prevented from being removed from the cable through hole 515 of the cover plate 510. This example is illustrated in FIG. 7.

The mounting plate 550 of the cable guide module 500 is provided to prevent a movement deviation of the swinging connection member 540 when connected to the cover plate 510. The mounting plate 550 may be fixed to the cover plate 510, and may include a communicating hole 551 that is positioned to correspond to the cable through hole 515. The mounting plate 550 may also include a covering end 552 that protrudes vertically from a circumference surface of the communicating hole 551 to cover a portion of the extension end 541 of the swinging connection member 540. An inner surface of the covering end 552 may have the same surface curvature (e.g., be a spherical surface) as an outer surface of the extension end 541 so as to be in close contact therewith.

Next, the rack gear assembly 600 of the refrigerator according to the embodiment of the present disclosure will be described. The rack gear assembly 600 is a device to automatically move the drawer 200 forward and backward due to a driving force of the driving part 400 provided in the cabinet 100.

Figure 11:
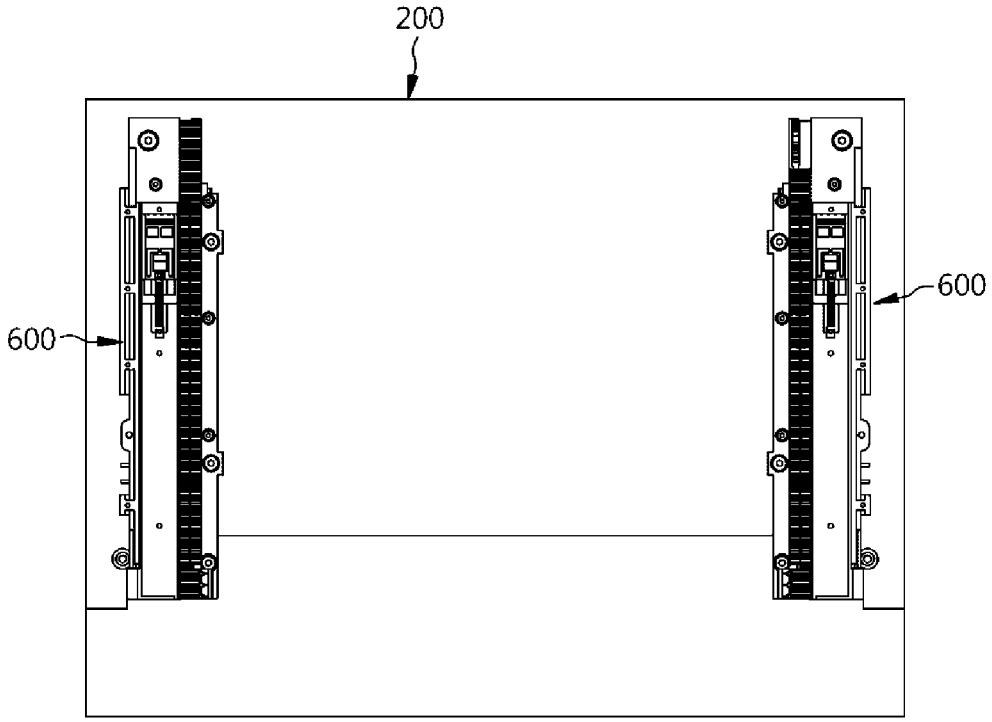
FIG. 11 is a bottom view illustrating installation states of rack gear assemblies of the refrigerator according to the embodiment of the present disclosure.
Figure 12:
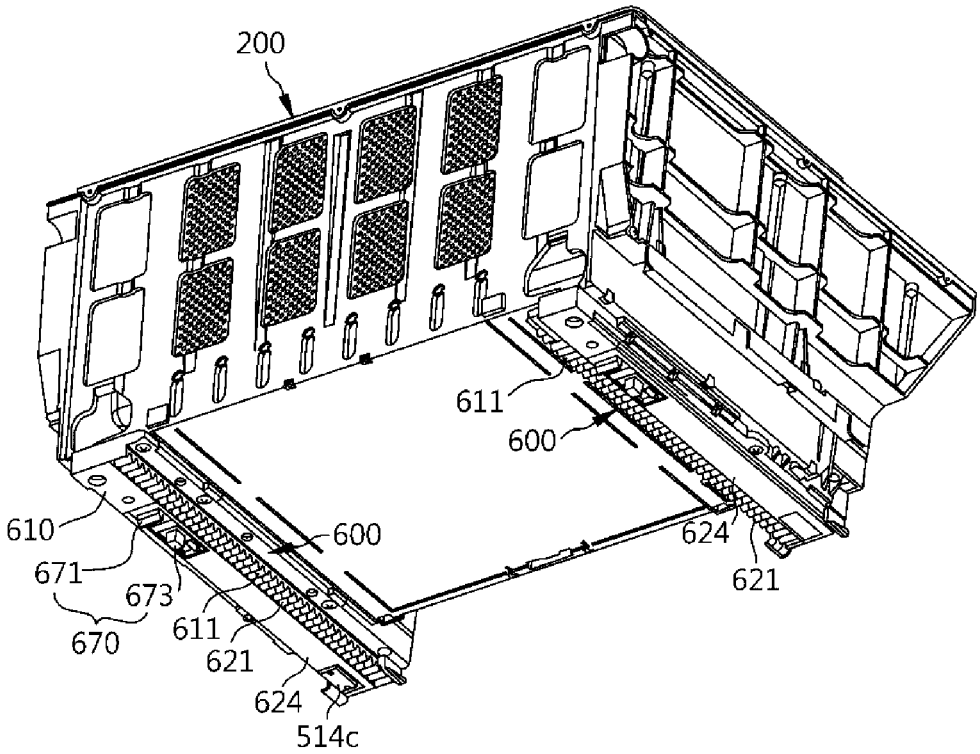
FIG. 12 is a perspective view illustrating the installation state of each of the rack gear assemblies of the refrigerator according to the embodiment of the present disclosure from a lower portion thereof.
Figure 13:
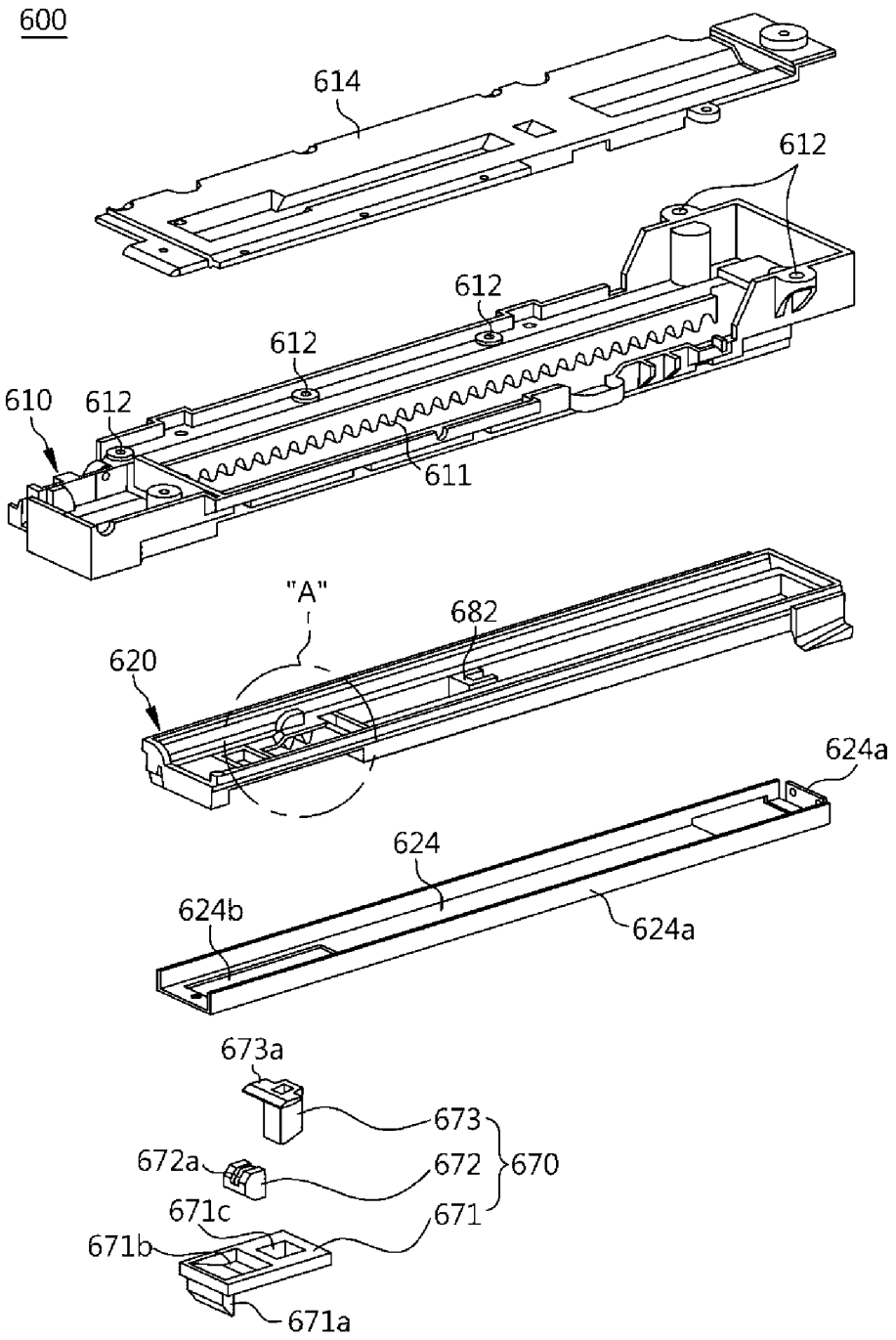
FIG. 13 is an exploded perspective view illustrating a state of a rack gear assembly of the refrigerator according to the embodiment of the present disclosure from an upper portion thereof.
Figure 14:
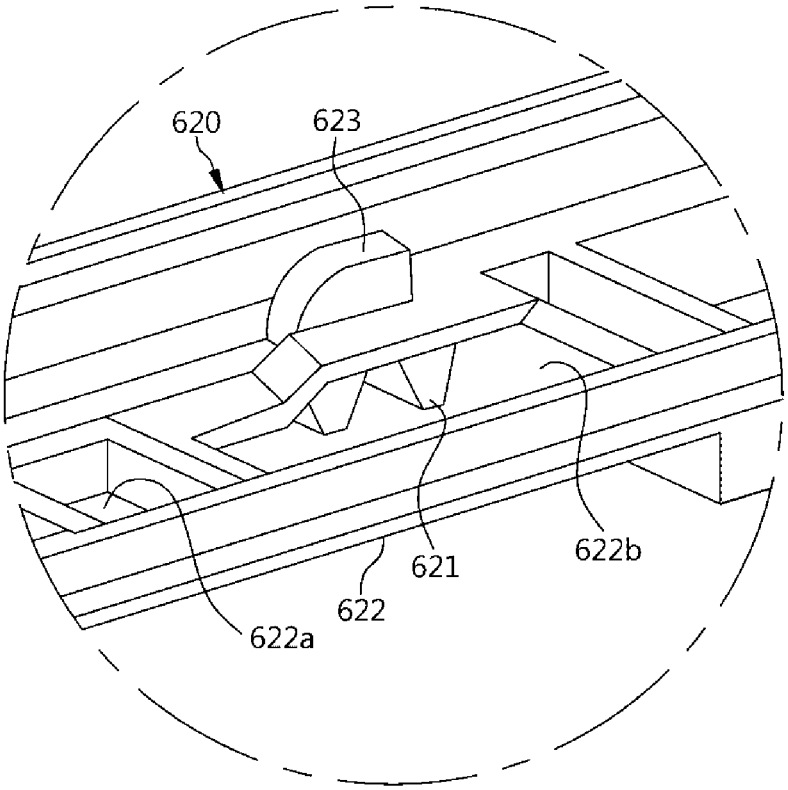
FIG. 14 is an enlarged view of an "A" portion of FIG. 13.

As illustrated in FIGS. 11 and 12, the rack gear assemblies 600 may be provided on opposite sides of the lower surface of the storage bin 220 included in the drawer 200. In other examples, a single rack gear assembly is included and positioned at a center or side of the drawer 200. In another example, three or more of each of the pinion 410 and the rack gear assembly 600 may be provided and paired with each other, such as positioning rack gear assemblies 600 at a center and at opposite sides of the drawer 200.

The rack gear assembly 600 may have rack gears 611 and 621 provided on a lower surface thereof such that gear teeth of the pinion 410 may be exposed to the inner part of the lower storage chamber 3 and engage the rack gears 611 and 621. In addition, the rack gears 611 and 621 of the rack gear assembly 600 may extend between a front side of the lower surface of the storage bin 220 to a rear side thereof. Accordingly, the drawer 200 provided with the rack gear assembly 600 can moved away from or moved close to the lower storage chamber 3 while the drawer 200 is moved forward and rearward by a rotating movement of the pinion 410.

Meanwhile, as a distance that the drawer 200 moves when automatically opening increases, convenience of use thereof improves. For example, as the storage bin 220 is maximally moved away from the lower storage chamber 3 by the drawer 200, it becomes easy to house the container 240 in the storage bin 220 or to store items or food in the storage bin. Furthermore, since the container 240 is automatically raised by the lift module 300 when the drawer 200 is opened, it is preferable for the storage bin 220 to maximally move away from the lower storage chamber 3.

To maximize a movement distance of the drawer 200, each of the opposite pinions 410 may be located at a front portion of the lower storage chamber 3, and each of the rack gears 611 and 621 may be configured to be able to maximally extend. For example, as each of the opposite pinions 410 may be located close to a front end of the lower storage chamber 3 and the rack gears 611 and 621 extend, an opening distance of the storage bin 220 may increase. However, in certain implementations, a bottom surface of the storage bin 220 may be configured to be shorter in length from front to rear than an open upper surface of the storage bin 220 (see, for example, FIGS. 4 and 5), there is a limit to extending the rack gears 611 and 621.

Accordingly, according to the embodiment, the rack gear assembly 600 may be configured to extend such that the opening distance of the storage bin 220 increases. For example, although a length between the front to rear of the storage bin 220 may be relatively short, the rack gear assembly 600 may extend such that the storage bin 220 is opened farther.

To this end, in an embodiment, the rack gear assembly 600 may include a first rack member (or first rack) 610, the second rack member (or second rack) 620, a first rack cover 614, a second rack cover 624, the confining protrusion part (or protrusion) 650, the confining module (or latch) 670, the noise reduction part (or noise reduction pad) 660. The rack gear assemblies 600 will be described in detail with respect to FIGS. 13 to 20.

As illustrated in the drawings, the first rack member 610 is configured to allow the storage bin 220 to be moved forward and backward by rotation of the pinion 410, wherein the first rack member 610 includes the rack gear (or first rack gear) 611. The first rack member 610 may be fixed to the storage bin 220 while an upper surface of the first rack member 610 may be in close contact with the lower surface of the storage bin 220. For example, a plurality of coupling holes 612 are provided in the first rack member 610 such that the first rack member 610 may be screwed or otherwise coupled to the storage bin 220. In addition, the first rack member 610 may include a movement guiding groove 613 provided in the lower surface thereof by being recessed therefrom, the movement guiding groove supporting a sliding movement of the second rack member 620 while the second rack member 620 is received in the movement guiding groove 613 (See FIG. 15).

The movement guiding groove 613 may be configured to be recessed from a front end portion of the first rack member 610 and to be formed through a rear surface of the first rack member 610. For example, the second rack member 620 may be received in the movement guiding groove 613 may be exposed to the rear of the movement guiding groove 613.

In addition, the rack gear 611 of the first rack member 610 may be provided at any one side of the movement guiding groove 613 (an opposing direction side of each of the opposite rack gear assemblies) in a longitudinal direction of the first rack member 610. For example, the rack gear 611 may be formed to a portion located at a further front side compared to the movement guiding groove 613.

Meanwhile, the first rack member 610 is further include a first rack cover 614. For example, an inner portion of the movement guiding groove 613 provided in the first rack member 610 may be configured to be open upward and downward. Accordingly, the movement guiding groove 613 may be configured to allow a holder 672 and a locking member (or latch) 673 of the confining module 670, which will be described later, to pass therethrough. The first rack cover 614 may be coupled to the first rack member 610 to cover the upper surface of the first rack member 610, and a lower surface of the first rack cover 614 may be configured to cover the open portion of the movement guiding groove 613 provided in the first rack member 610 and to form an upper surface of the movement guiding groove 613. In one implementation, the first rack cover 614 is provided to be a metal plate so as to reinforce an insufficient rigidity of the first rack member 610.

Figure 15:
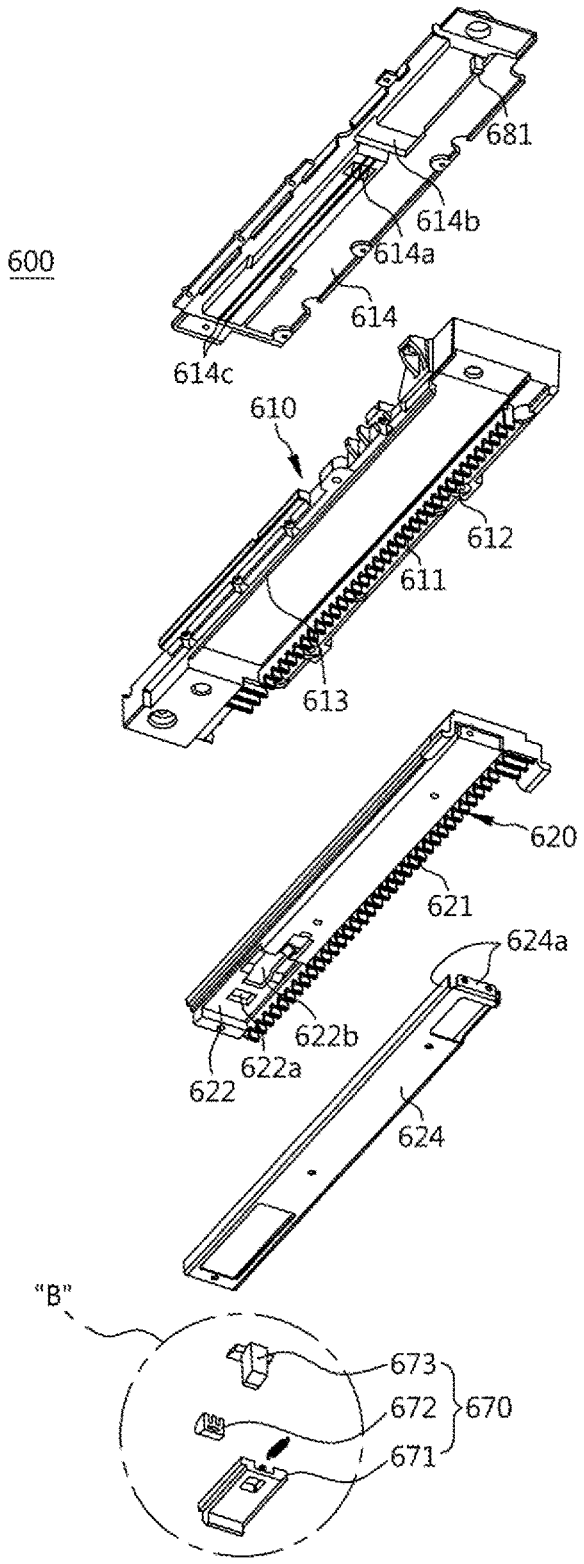
FIG. 15 is an exploded perspective view illustrating a state of the rack gear assembly of the refrigerator according to the embodiment of the present disclosure from the lower portion thereof.
Figure 16:
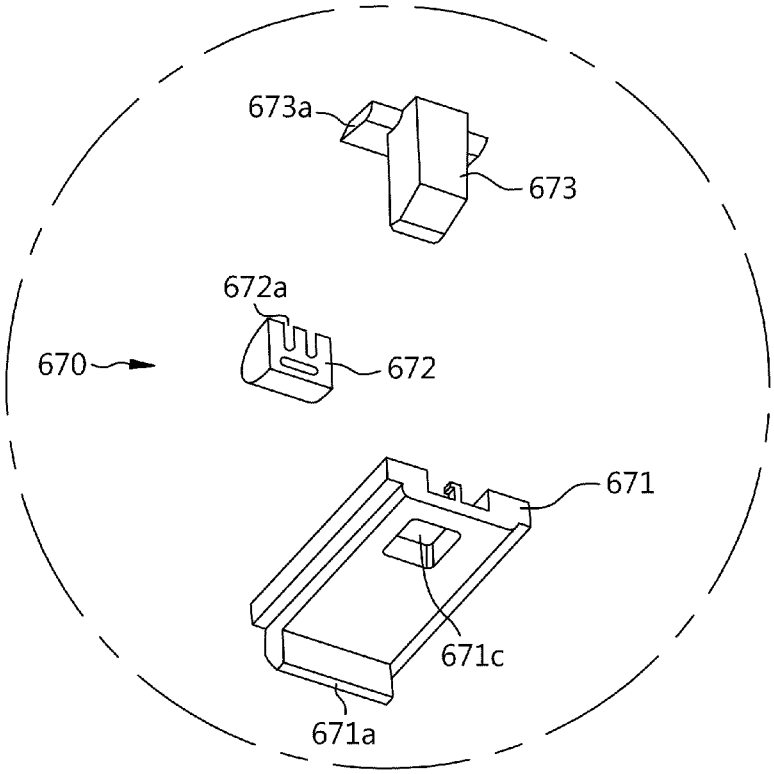
FIG. 16 is an enlarged view of a "B" portion of FIG. 15.
Figure 17:
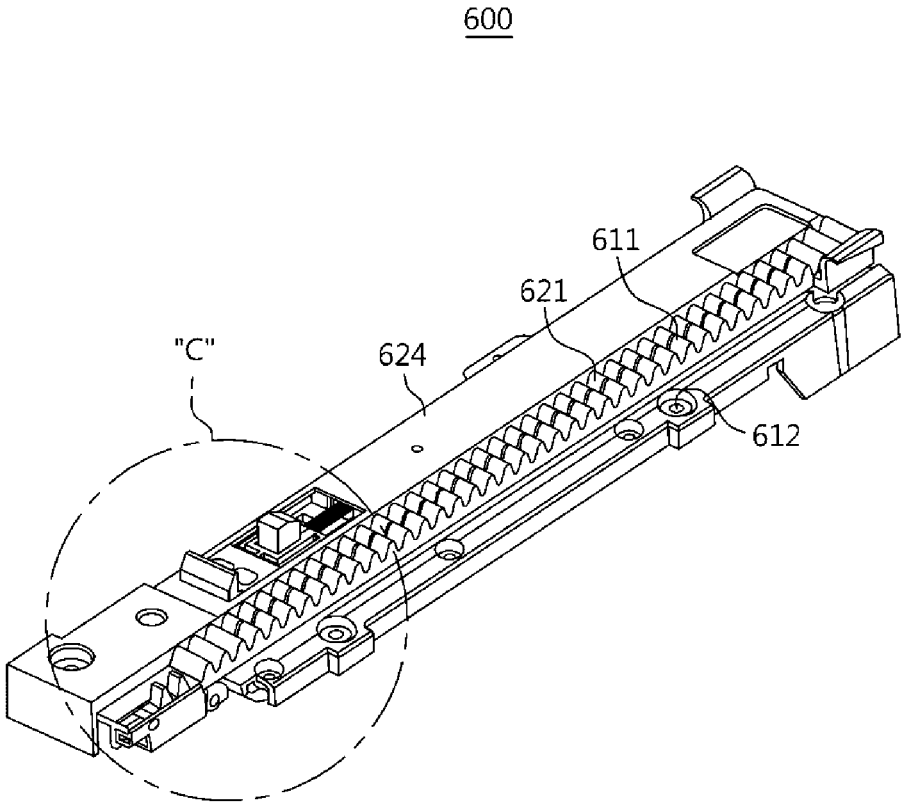
FIG. 17 is a perspective view of the rack gear assembly upside down to illustrate a structure of a lower surface of the rack gear assembly of the refrigerator according to the embodiment of the present disclosure.
Figure 18:
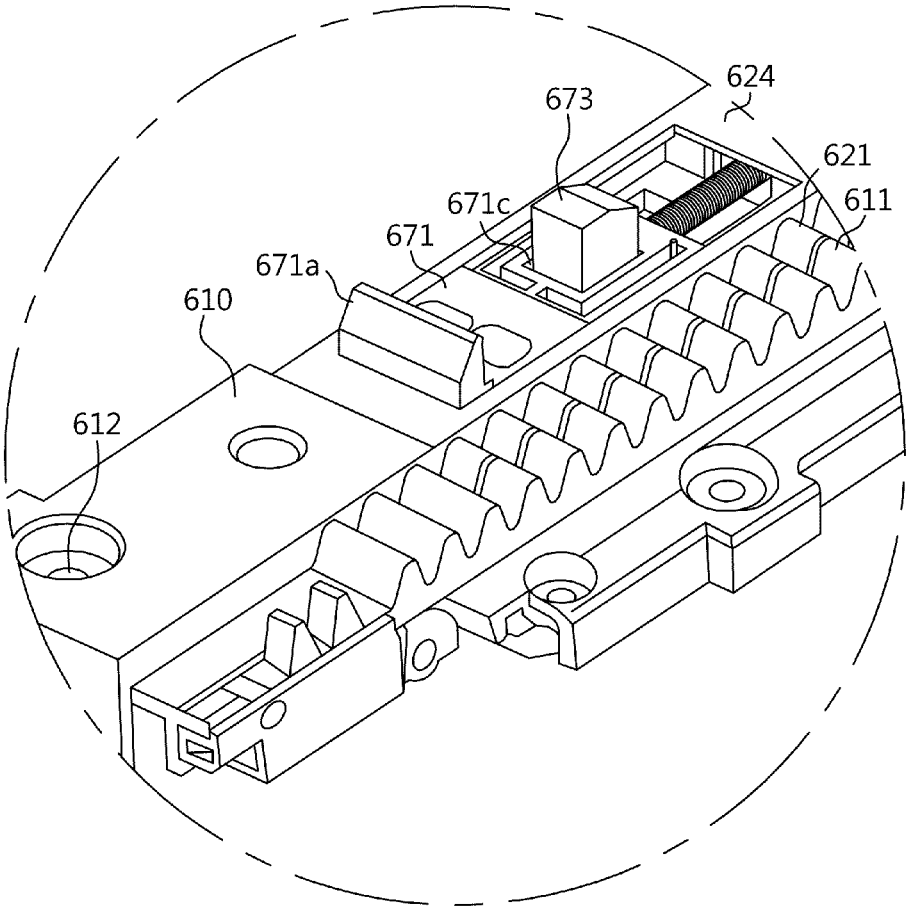
FIG. 18 is an enlarged view of a "C" portion of FIG. 17.
Figure 19:
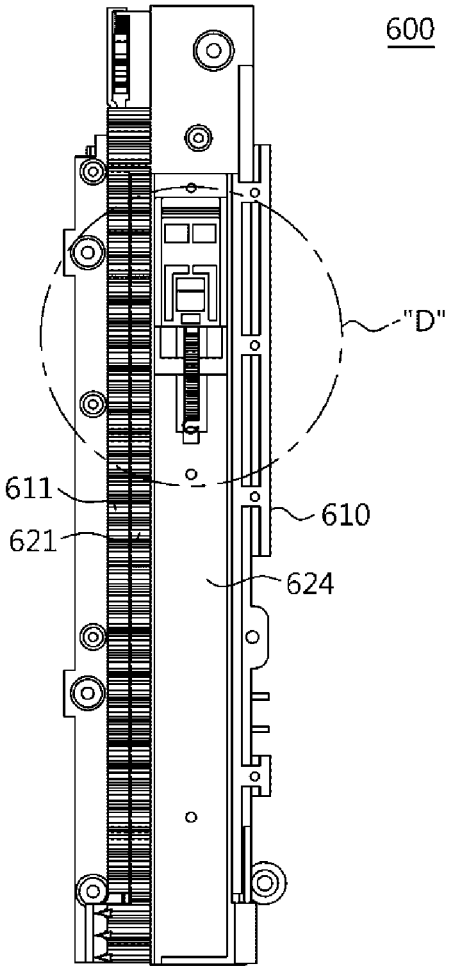
FIG. 19 is a bottom view illustrating a structure of the lower surface of the rack gear assembly of the refrigerator according to the embodiment of the present disclosure.
Figure 20:
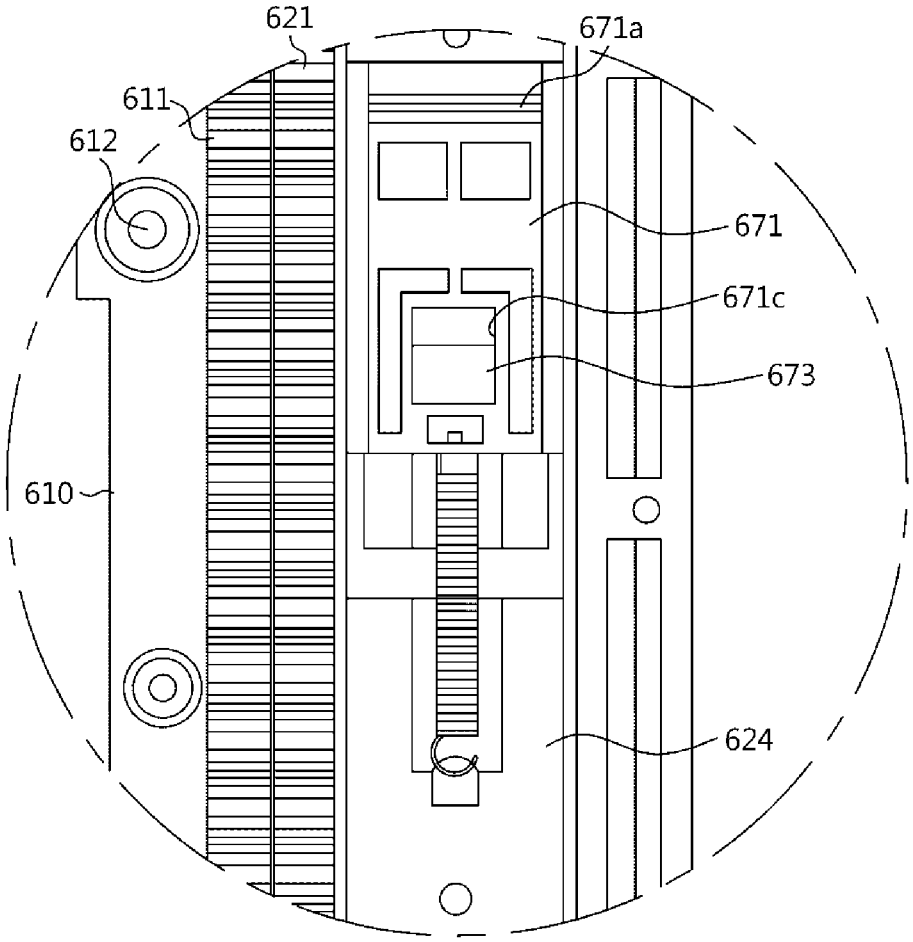
FIG. 20 is an enlarged view of a "D" portion of FIG. 19.

In addition, a lower surface (an upper surface of an inner part of the movement guiding groove) of the first rack cover 614 may include receiving grooves 614*a* and 614*b* provided thereon. The holder 672 and the locking member 673 of the confining module 670, to be described later, may be received into the receiving grooves 614*a* and 614*b*, respectively. This feature is illustrated in FIG. 15.

The receiving grooves 614*a* and 614*b* may include a first receiving groove 614*a* receiving the holder 672 and a second receiving groove 614*b* receiving the locking member 673. The two receiving grooves 614*a* and 614*b* may be spaced apart from each other along a moving direction of the first rack member 610. For example, a distance between a rear surface of the first receiving groove 614*a* and a rear surface of the second receiving groove 614*b* may be longer than a distance defined between a rear surface of the holder 672 and a rear surface of the locking member 673. After the holder 672 is first received into the first receiving groove 614*a*, the locking member 673 may be received into the second receiving groove 614*b*.

Accordingly, the first rack member 610 and the first rack cover 614 may be manufactured independently of each other and then coupled together. In another embodiment, the first rack cover 614 and the first rack member 610 may be provided as a single body, such forming the two components in a single body by injection molding. However, when the first rack member 610 and the first rack cover 614 are formed as the single body, the injection molding may be difficult to perform since a recessed shape or direction of each portion of the first rack member 610 and the first rack cover 614 may be different.

The second rack member 620 may move the storage bin 220 forward and backward in cooperation with the first rack member 610. For example, when the first rack member 610 receives a rotational force of the pinion 410 and moves forward by a predetermined distance while the second rack member 620 is received into the movement guiding groove 613 of the first rack member 610, the second rack member 620 may also be moved forward by being pulled by the first rack member 610. Subsequently, the second rack member 620 is moved forward by the rotational force of the pinion 410. Accordingly, although the rack gear 611 of the first rack member 610 moves away from the pinion 410, the first rack member 610 may be further extended.

Figure 26:
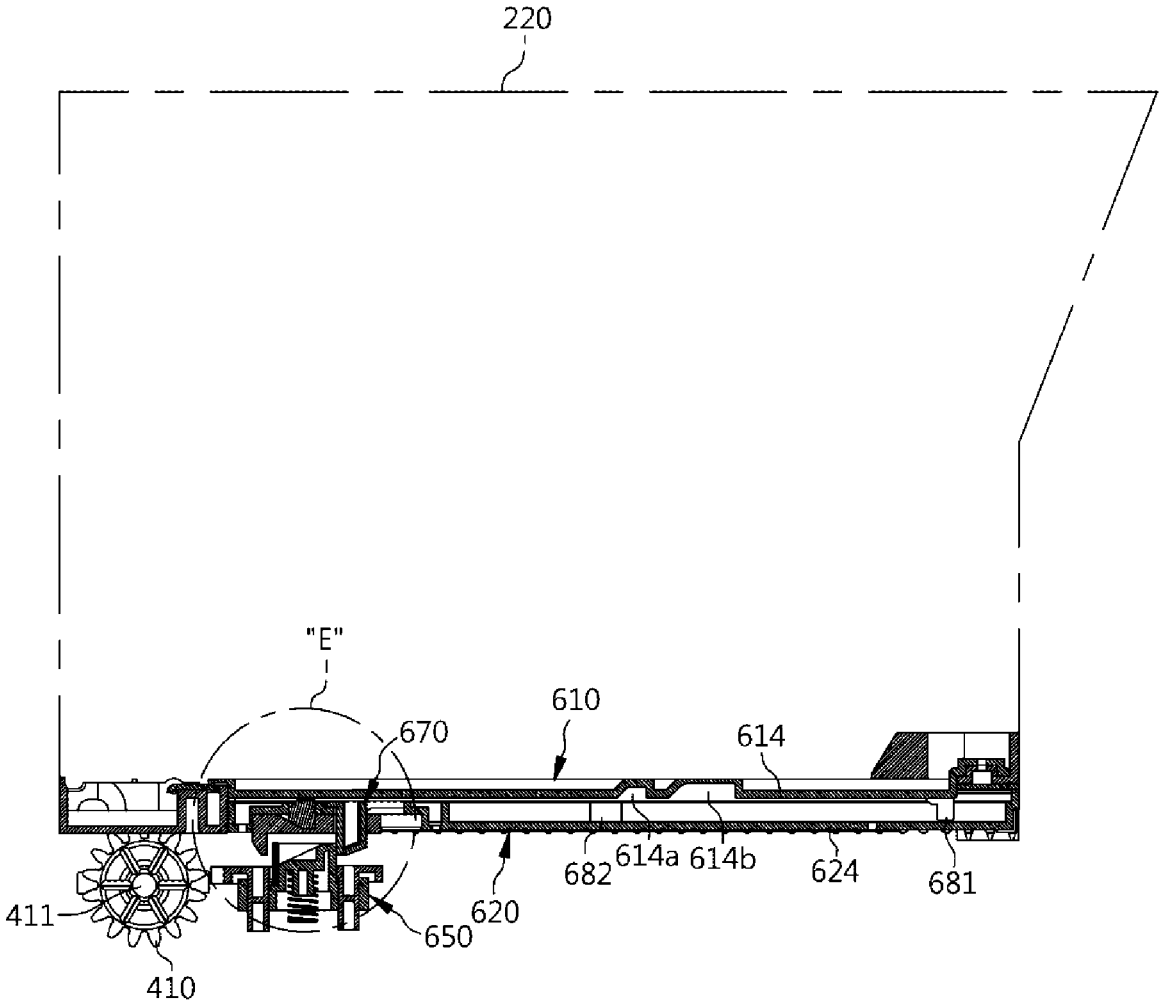
FIGS. 26, 28, 30, and 32 are operation state views illustrating operation states of the rack gear assembly in a process in which the storage bin of the refrigerator according to the embodiment of the present disclosure is opened.
Figure 28:
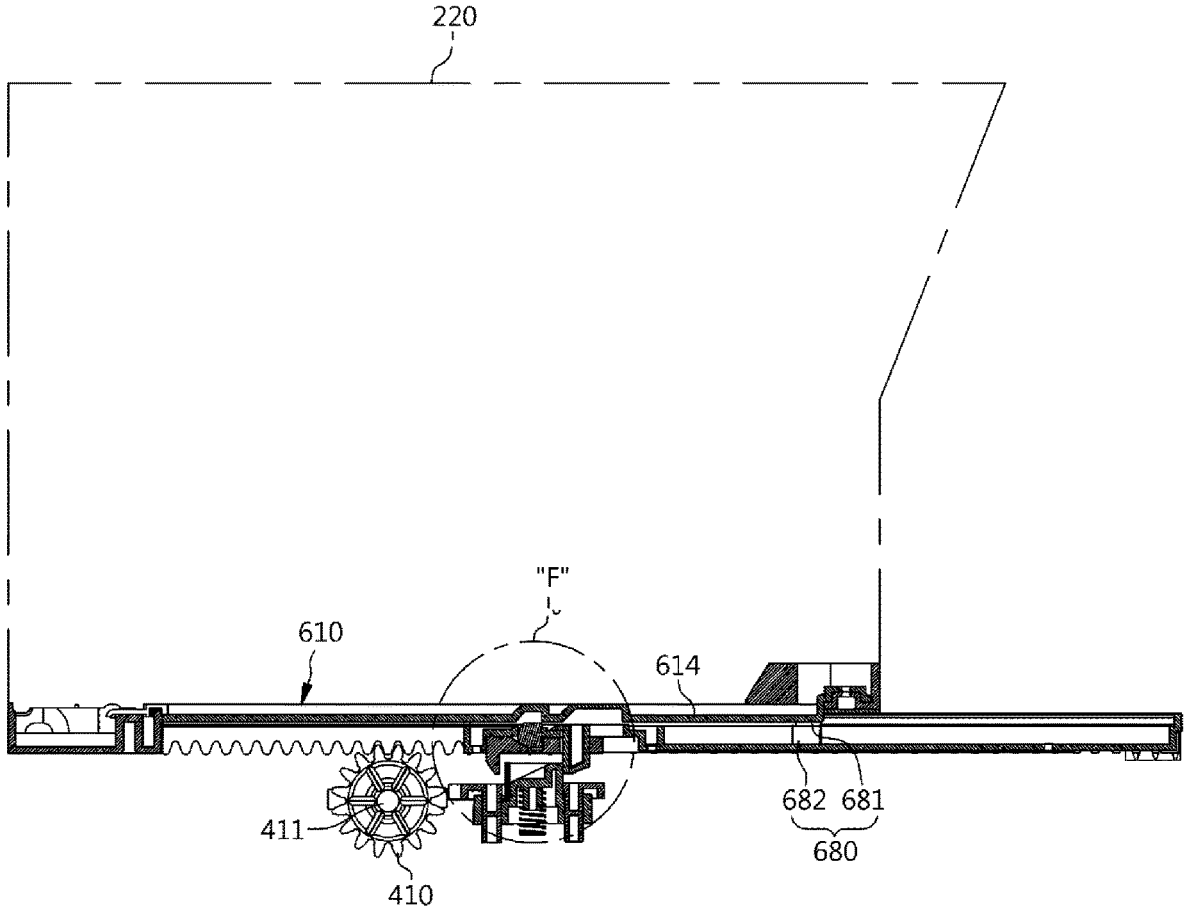

In certain configurations, the first rack member 610 may be configured to pull and move the second rack member 620 in cooperation with a linkage part 680. The linkage part 680 may include a linkage protrusion 681 (See FIG. 15) provided on a lower surface (the upper surface of the inner part of the movement guiding groove) of the first rack cover 614, which will be described later, and a linkage step 682 (See FIG. 13) provided on an upper surface of the second rack member 620. When the first rack member 610 moves forward by a predetermined distance, the linkage protrusion 681 and the linkage step 682 are configured to collide with each other and move the second rack member 620 forward. Operation of the linkage part 680 is illustrated in FIGS. 26 and 28.

In other examples, although not shown, the linkage protrusion 681 may be provided in the first rack member 610. In addition, although not shown, the linkage protrusion 681 may be provided on the upper surface of the second rack member 620 and the linkage step 682 may be provided on a lower surface of the first rack member 610.

Furthermore, while the second rack member 620 is completely received into the movement guiding groove 613 of the first rack member 610, a distance defined between the linkage step 682 and the linkage protrusion 681 may be set such that the first rack member 610 moves forward without influencing the second rack member 620. This set distance may be determined in consideration of a size of the storage bin 220 and/or the entire opening distance of the storage bin 220.

In addition, the rack gear (or second rack gear) 621 may be provided in the second rack member 620. The rack gear 621 may be positioned in parallel with the rack gear 611 of the first rack member 610 at a side portion thereof. For example, a front end of the rack gear 621 may be positioned at a rear side compared to a front end of the rack gear 611 of the first rack member 610, and a rear end of the rack gear 621 may be configured to extend to a further rear side compared to a rear end of the rack gear 611 of the first rack member 610.

For example, the rack gears 611 and 621 of the first rack member 610 and the second rack member 620 may be configured to receive the driving force generated by the pinion 410. For example, the pinion 410 may be configured to have a width corresponding to a size of the rack gear 611 of the first rack member 610 and the rack gear 621 of the second rack member 620 when overlapped together such that each of the rack gears 611 and 621 accurately receives the driving force from the pinion 410.

In addition, a motion groove 622 may be formed to be recessed in a lower surface of a front end of the second rack member 620. The motion groove 622 may provide a moving space allowing a stopper member (or stopper frame) 671 of the confining module 670, which will be described later, to move forward and backward while the stopper member 671 is received in and mounted in the motion groove 622.

In addition, a plurality of through holes 622*a* and 622*b* may be provided in the motion groove 622 by being formed through an upper part thereof. The through holes 622*a* and 622*b* may include a first through hole 622*a* through which the holder 672 of the confining module 670, which will be described later, passes and a second through hole 622*b*, through which the locking member 673 passes. For example, the second through hole 622*b* may be formed to be a longitudinal hole in forward and backward directions such that the locking member 673 may move forward and backward within the second through hole 622*b*.

Meanwhile, may be provided on a lower surface of the second rack member 620. For example, the second rack cover 624 may be configured to cover the lower surface of the second rack member 620. The second rack cover 624 may prevent the stopper member 671 mounted to the motion groove 622 of the second rack member 620 from deviating to the outside.

The second rack cover 624 may be a plate made of a metal or other substantially strong material and is positioned to cover the lower surface of the second rack member 620. Accordingly, the second rack member 620 can be prevented from being deformed, e.g. twisting or bending, by the second rack cover 624. In some examples, at least one partial open portion may be provided on the second rack cover 624 to reduce weight thereof.

In one example, second rack cover 624 may include a folded end (or vertical walls) 624*a* on each of opposite side surfaces and a rear surface of the second rack cover 624 so as to cover a portion of each of the opposite side surfaces and the rear surface of the second rack member 620, thereby preventing twisting of the second rack member 620. In addition, a stopper exposure hole 624*b* may be provided at a front end portion of the second rack cover 624 and may allow a portion of the stopper member 671, which will be described later, to be exposed therethrough.

The confining protrusion part 650 may be provided to confine the second rack member 620. The confining protrusion part 650 may have an upper surface of which is closed and a lower part of which is open, and may be provided at a front of the upper surface (e.g., the bottom surface of the inner part of the storage chamber) of the bottom 120 of the cabinet 100.

Figure 21:
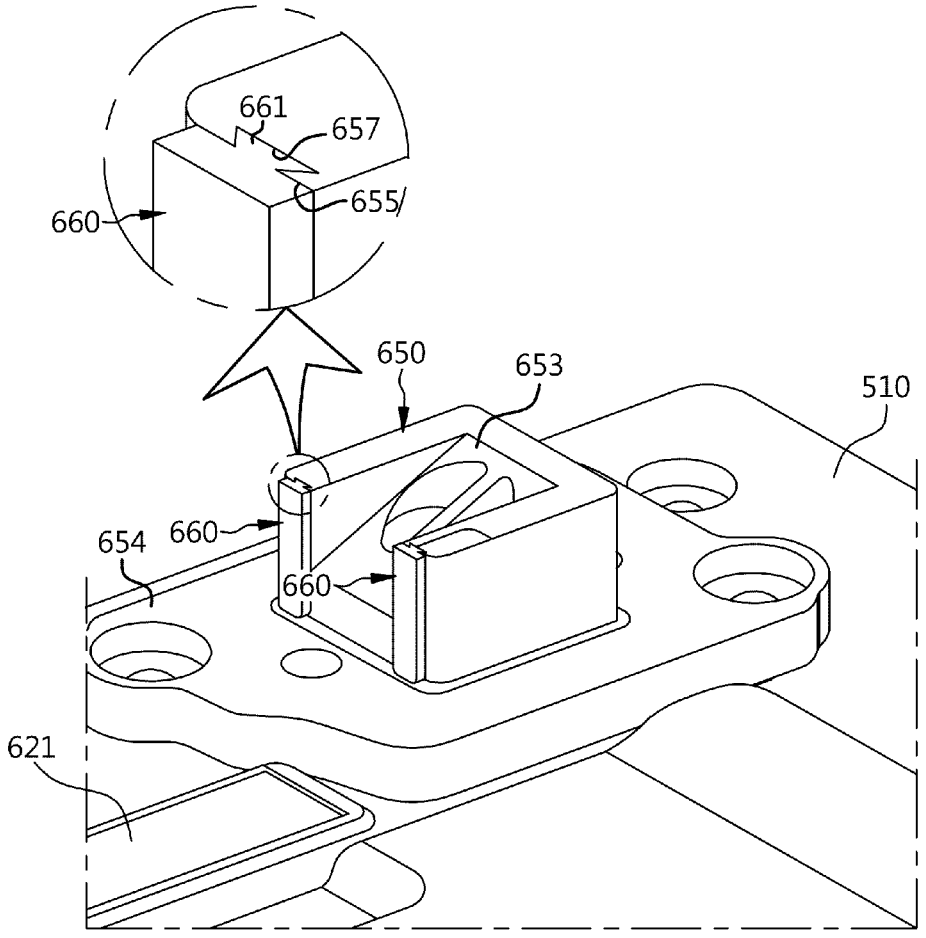
FIG. 21 is a perspective view of an important part illustrating an installation structure of the confining protrusion part of the refrigerator according to the embodiment of the present disclosure.

For example, as illustrated in FIG. 21, the confining protrusion part 650 may be installed in the protrusion passing hole 513 formed through the cover plate 510. If the cover plate 510 is omitted, the protrusion passing hole 513 may be provided on an upper surface (e.g., the bottom surface of the inner part of the storage chamber) of the bottom 120 of the cabinet 100 by being spaced therefrom, and the confining protrusion part 650 may be installed in the protrusion passing hole 513.

A width of an inner part of the protrusion passing hole 513 may be larger than a width of an outer surface of the confining protrusion part 650, and external exposure of a gap caused by difference between the width of the protrusion passing hole 513 and the width of the confining protrusion part 650 may be covered by the confining holder 654.

The confining holder 654 may be combined with the upper surface (or the upper surface of the bottom) of the cover plate 510. For example, a protrusion through hole 654*a*, through which the confining protrusion part 650 passes, may be formed in a center portion of the confining holder 654, and an outer portion of the confining holder 654 may be combined with the cover plate 510 by covering the gap between the protrusion passing hole 513 and the confining protrusion part 650.

In addition, a combination end 656 may be provided on the outer surface of the confining protrusion part 650 and may protrude outward therefrom. A lift guide 654*b* vertically passing through the combination end 656 may be provided on a lower surface of the confining holder 654 and may protrude therefrom. For example, the combination ends 656 may be provided on opposite sides of the confining protrusion part 650 to protrude therefrom, and lift guides (or guide bosses) 654*b* may be provided on opposite sides of the confining holder 654 so as to pass through respective ones of the combination ends 656.

Each of the lift guides 654*b* may support a vertical movement of the confining protrusion part 650. Furthermore, the confining protrusion part 650 may be installed to be elastically moved upward and downward in the protrusion passing hole 513 by an elastic member 651. For example, when the confining protrusion part 650 is pressed, the confining protrusion part 650 may be moved downward into the protrusion passing hole 513. Conversely, when the confining protrusion part 650 is not pressed, the confining protrusion part may be moved upward in the protrusion passing hole 513, and a portion of the confining protrusion part 650 may extend into a inner part of the lower storage chamber 3.

In some examples, the elastic member 651 may be configured as a coil spring. A spring engagement protrusion 652 may be provided on the confining protrusion part 650 and may protrude downward therefrom (See FIG. 27). The elastic member 651 may be combined at an upper end thereof with the spring engagement protrusion 652 in the confining protrusion part 650 by passing through a lower part of the confining protrusion part 650.

In one example, the confining protrusion part 650 may be positioned at a rear side of the pinion 410 and may be be substantially adjacent to the pinion 410. For example, the confining protrusion part 650 may be positioned less than a threshold distance (e.g., 10 cm) from the pinion 410.

A slope (or sloped surface) 653 may be provided at a middle of an upper surface of the confining protrusion part 650. The slope 653 may be gradually inclined upward toward a rear of the confining protrusion part 650 from a front thereof. As the locking member 673 of the confining module 670 moves backward on the slope 653, the confining protrusion part 650 may be configured to move downward.

In addition, a front surface of the confining protrusion part 650 may have flat portions or flat surfaces 655. In this case, the flat portions 655 may be opposite side portions associated of the slope 653, and a confining hook 671*a* of the stopper member 671, which will be described hereinbelow, may contact the flat portions 655 such that a backward movement of the stopper member 671 is selectively prevented.

The confining module 670 may confine and limit a motion of the second rack member 620 until the first rack member 610 has moved forward by a prescribed distance. For example, the confining module 670 may include the stopper member (or latch) 671, the holder 672, and the locking member (or locking frame) 673.

The stopper member 671 may be provided in the motion groove 622 of the second rack member 620 and may restrict a backward movement of the second rack member 620. A length of the stopper member 671 from a front of the stopper member 671 to a rear thereof may be shorter than a length of the motion groove 622 from a front of the motion groove 622 to a rear thereof. Accordingly, the stopper member 671 may be installed to slide to move in forward and backward directions in the motion groove 622.

In addition, the confining hook 671*a* may be provided on a lower surface of the front end of the stopper member 671 by protruding downward therefrom. For example, when the drawer 200 is moved backward by a predetermined distance, the confining hook 671*a* may contact the flat portion 655 of the front surface of the confining protrusion part 650 such that the stopper member 671 and the first rack member 610 may not move further backward.

In addition, a holder groove 671*b* may be provided on an upper surface of the front of the stopper member 671, and a locking member through hole 671*c* may be provided on a rear portion of the stopper member 671. For example, the locking member through hole 671*c* may be vertically formed through the rear portion of the stopper member 671.

The holder groove 671*b* may gradually incline downward toward a rear thereof. For example, when the holder 672 is received into the holder groove 671*b* and moves forward, the holder 672 can move away from the holder groove 671*b*.

The holder 672 may restrict forward and backward movements of the stopper member 671. A lower end of the holder 672 may be received into the holder groove 671*b* of the stopper member 671, and an upper end of the holder 672 may pass through the first through hole 622*a* of the second rack member. When the first rack member 610 moves forward by a predetermined distance and pulls the second rack member 620, the holder 672 may escape from the holder groove 671*b* while moving forward together with the second rack member 620 and may be received into the first receiving groove 614*a* of the first rack cover 614.

In some implementations, each of a front upper edge of the holder 672 and a front lower edge may be inclined. The inclination of the front lower edge of the holder 672 may corresponds to the inclination of the holder groove 671*b*. Accordingly, the holder 672 may efficiently escape from the holder groove 671*b*.

The holder 672 may include a cut groove 672*a* provided in an upper surface thereof and extended in forward and backward directions. An insert protrusion 614*c* received into the cut groove 672*a* may be provided on a lower surface of the first rack cover 614 facing the upper surface of the holder 672. For example, the insert protrusion 614*c* may be provided from a front end of the first rack cover 614 to extend into an interior of the first receiving groove 614*a*. Due to a structure of the cut groove 672*a* and the insert protrusion 614*c*, while the first rack member 610 moves, leftward and rightward movements of the holder 672 are prevented such that the insert protrusion 614*c* may be accurately received into the first receiving groove 614*a*. In some examples, multiple pairs of the cut groove 672*a* and the insert protrusion 614*c* may be provided.

The locking member 673 may be positioned at a rear of the confining protrusion part 650 and may be held by the confining protrusion part 650 until the first rack member 610 is moved forward by a predetermined distance to prevent a forward movement of the second rack member 620. When the second rack member 620 and the second rack cover 624 move together with the first rack member 610 and the first rack cover 614 by the predetermined distance, the locking member 673 may move upward and may be received in the second receiving groove 614*b* of the first rack cover 614 that is positioned to correspond to an upper part of the locking member 673. Accordingly, the locking member 673 confined by the confining protrusion part 650 may be released due to the motion of the movement of first rack member 610.

An extending step 673*a* may be provided at an upper end of the locking member 673, such as to extend to opposite sides thereof, and lifting guide steps 623 (see FIG. 14) having a round (or inclined) shape may be provided at opposite sides of the second through hole 622*b* on an upper surface of the front end of the second rack member 620. The extending step 673*a* may be lifted while the first rack member 610 and the first rack cover 614 are moved forward by a predetermined distance and move together with the second rack member 620 and the second rack cover 624.

For example, when the first rack member 610 and the first rack cover 614 are moved forward by a predetermined distance and move together with the second rack member 620 and the second rack cover 624, the lifting guide step 623 in the second rack member 620 may allow the extending step 673*a* of the locking member 673 to be lifted. Accordingly, the locking member 673 may move upward to a height at which the locking member 673 does not contact the confining protrusion part 650.

The lifting guide step 623 may be gradually inclined or rounded upward toward a rear thereof. For example, the lifting guide step 623 may be gradually incline upward toward a rear of the second through hole 622*b* from a middle portion of each of opposite sides thereof. When the locking member 673 is positioned at the front of the second through hole 622*b*, the locking member 673 may not be influenced by the lifting guide step 623. As the locking member 673 is moved to the rear of the second through hole 622*b* by a forward movement of the second rack member 620, the locking member 673 may be influenced by the lifting guide step 623 and may be gradually moved upward.

In certain implementations, the extending step 673*a* of the locking member 673 may be configured to have a round or inclined shape correspond to a shape of a corresponding surface of the lifting guide step 623. In addition, a lower surface of the locking member 673 may gradually incline upward toward a rear thereof. Inclination of the lower surface of the locking member 673 may correspond to the inclination of the slope 653 provided at the middle of the upper surface of the confining protrusion part 650.

The noise reduction part 660 may reduce the impact noise when the stopper member 671 collides with the confining protrusion part 650. Furthermore, the noise reduction part 660 may also help prevent the stopper member 671 or the confining protrusion part 650 from being damaged by reducing impact between the stopper member 671 and the confining protrusion part 650.

The noise reduction part 660 may be provided on at least one of a rear surface of the confining hook 671*a* of the stopper member 671 or an opposing front surface of the confining protrusion part 650. Accordingly, when the confining hook 671*a* contacts with the confining protrusion part 650, the noise reduction part may help prevent impact associated with a direct contact of the opposing surfaces of the confining hook 671*a* and the confining protrusion part 650. This configuration is illustrated in FIG. 21.

The noise reduction part 660 is made of a material having a cushioning effect. For example, noise reduction part 660 may be made of a rubber material, a pliable plastic material, a fabric, cork, or other deformable material.

According to an embodiment, the noise reduction part 660 may be provided on the front surface of the confining protrusion part 650 and may block a contact between the confining protrusion part 650 and the confining hook 671*a* included in the stopper member 671. For example, the noise reduction part 660 may be installed on each of the flat portions 655 of the front surface of the confining protrusion part 650. Since the slope 653 of the confining protrusion part 650 may be gradually inclined upward toward a rear thereof, the slope 650 may not contact the confining hook 671*a*. Accordingly, the noise reduction part 660 may be installed only on the flat portion 655 that the confining hook 671*a* may contact.

The noise reduction part 660 may be installed on the flat portion 655 using an adhesive or an adhesive tape or he noise reduction part 660 may be screwed to the flat portion 655. However, long term use may cause the noise reduction part 660 to fall from the flat portion 655 due to deterioration of adhesion or as the noise reduction part 660 may be torn. Furthermore, installing the noise reduction part at a correct position is difficult. Accordingly, workability may be deteriorated.

Accordingly, according to an exemplary embodiment, the noise reduction part 660 may be fitted onto and coupled to the flat portion 655. The noise reduction part 660 can be fitted onto the flat portion such that the noise reduction part 660 is not removed from the flat portion 655 even after long-term use. Various types of structures fit together the flat portion 655 and the noise reduction part 660 may be used.

Figure 22:
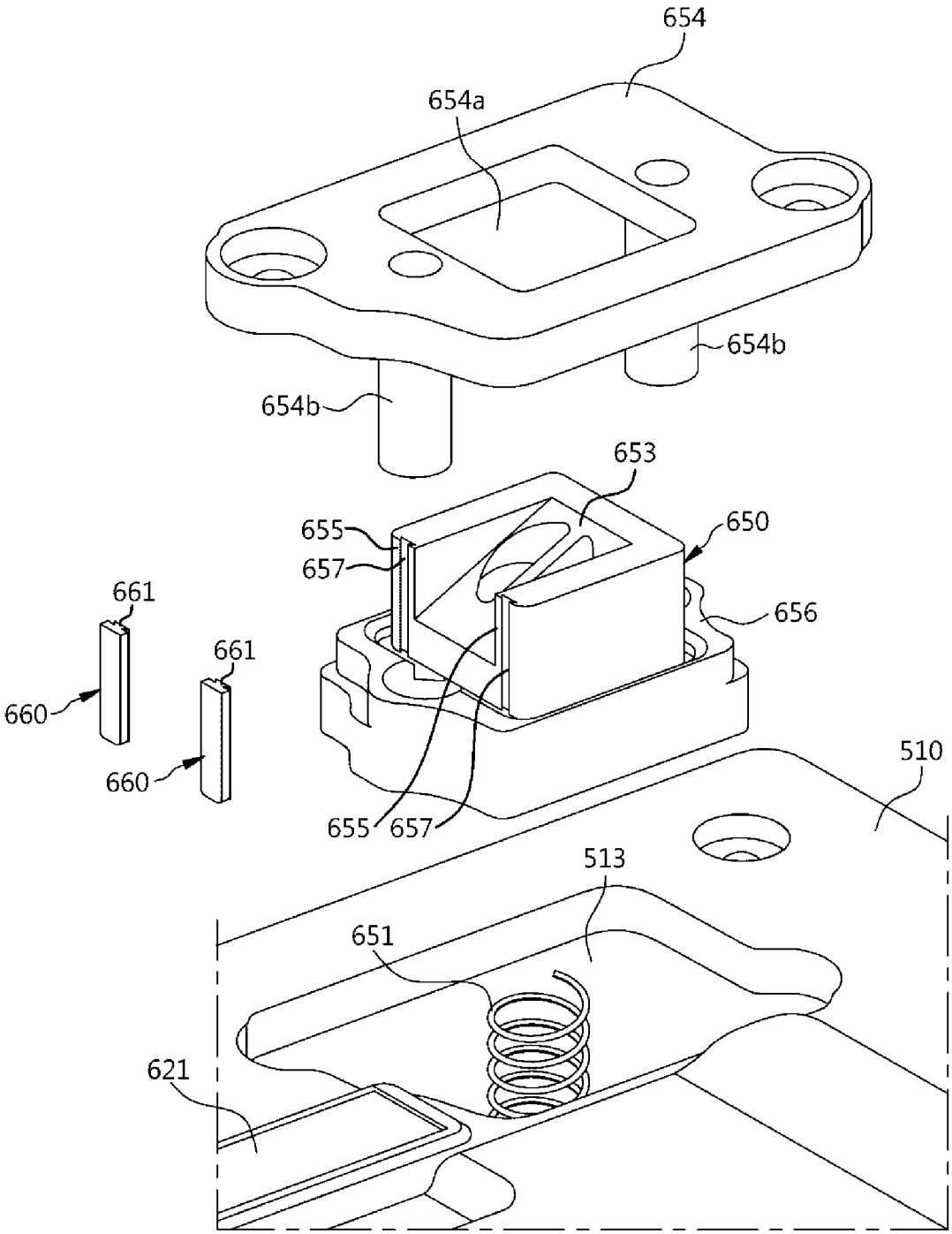
FIG. 22 is an exploded perspective view of the important part illustrating the installation structure of the confining protrusion part of the refrigerator according to the embodiment of the present disclosure.

For example, as illustrated in FIGS. 21 and 22, a fitting groove 657 may be provided on each of the flat portions 655 of the confining protrusion part 650 by being recessed therefrom, and a fitting protrusion 661 may be provided on the noise reduction part 660 by protruding therefrom. The fitting protrusion 661 may be fitted into and coupled to the fitting groove 657.

Figure 23:
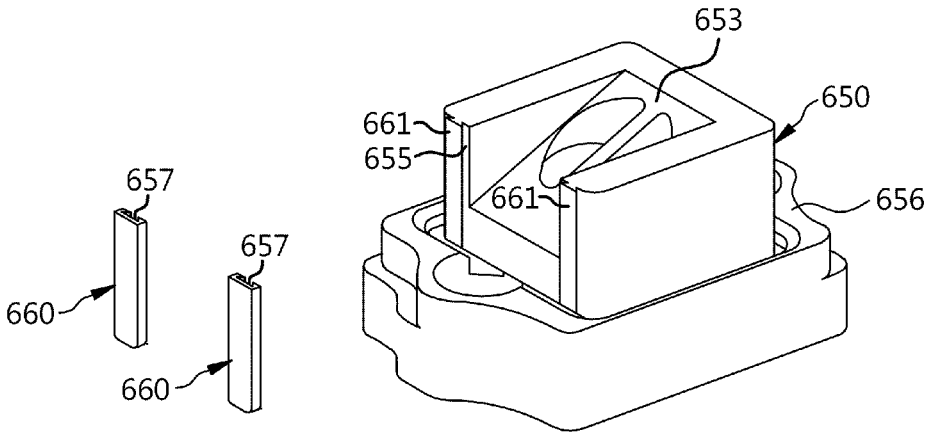
FIG. 23 is an exploded perspective view illustrating another embodiment of a structure in which a noise reduction part of the refrigerator according to the embodiment of the present disclosure is installed in the confining protrusion part.

In another example illustrated in FIG. 23, the fitting protrusion 661 may be provided on each of the flat portions 655 of the confining protrusion part 650 by protruding therefrom, and the fitting groove 657 may be provided in the noise reduction part 660 by being recessed therefrom. Accordingly, the fitting protrusion 661 may be fitted into the fitting groove 657 may be combined with each other to coupled together the flat portion 655 and the noise reduction part 660.

Figure 24:
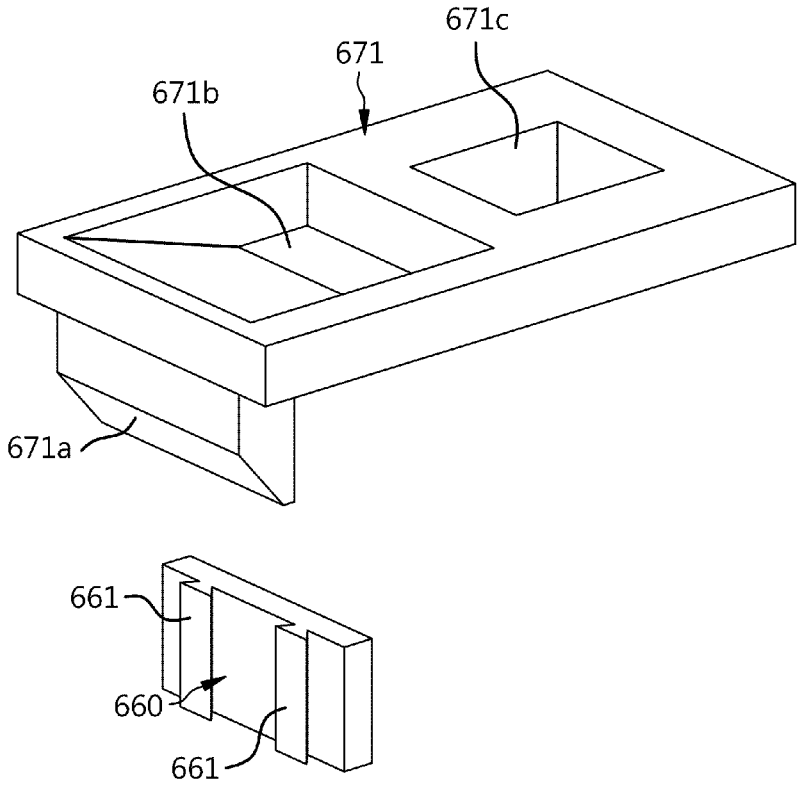
FIG. 24 is an exploded perspective view illustrating an example in which the noise reduction part of the refrigerator according to the embodiment of the present disclosure is installed in the stopper member.
Figure 25:
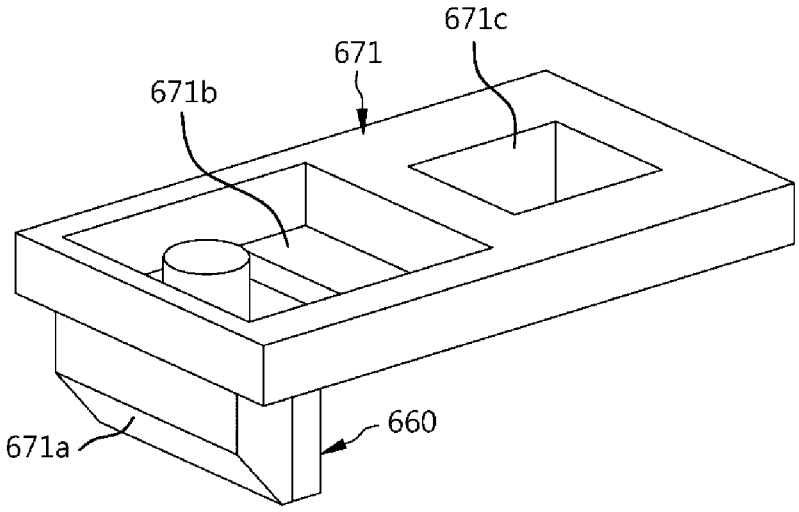
FIG. 25 is a perspective view illustrating an example in which the noise reduction part of the refrigerator according to the embodiment of the present disclosure is installed in the stopper member.

In another example illustrated in FIGS. 24 and 25, the noise reduction part 660 may be positioned on an inner surface (e.g., a contact surface of the confining hook 671*a* with the confining protrusion part) of the confining hook 671*a* of the stopper member 671. For example, the noise reduction part 660 may be positioned on a surface of the confining hook 671*a* that faces a front surface of the confining protrusion part 650.

Furthermore, the fitting groove 657 may have a trapezium structure gradually extending to opposite sides thereof toward an inner part thereof. Accordingly, the fitting protrusion 661 fitted into the fitting groove in a vertical may be prevented from being unintentionally removed from the fitting groove in a horizontal direction (e.g., in a travel direction of the rack assembly 600).

In addition, the fitting groove 657 may be configured to be open to an upper part of the confining protrusion part 650, and the fitting protrusion 661 may be configured to be vertically fitted into and combined with the fitting groove. Consequently, although the confining protrusion part 650 would not removed from the protrusion passing hole 513 by disassembling the confining holder 654 from the confining protrusion part, the noise reduction part 660 can be easily replaced.

Figure 27:
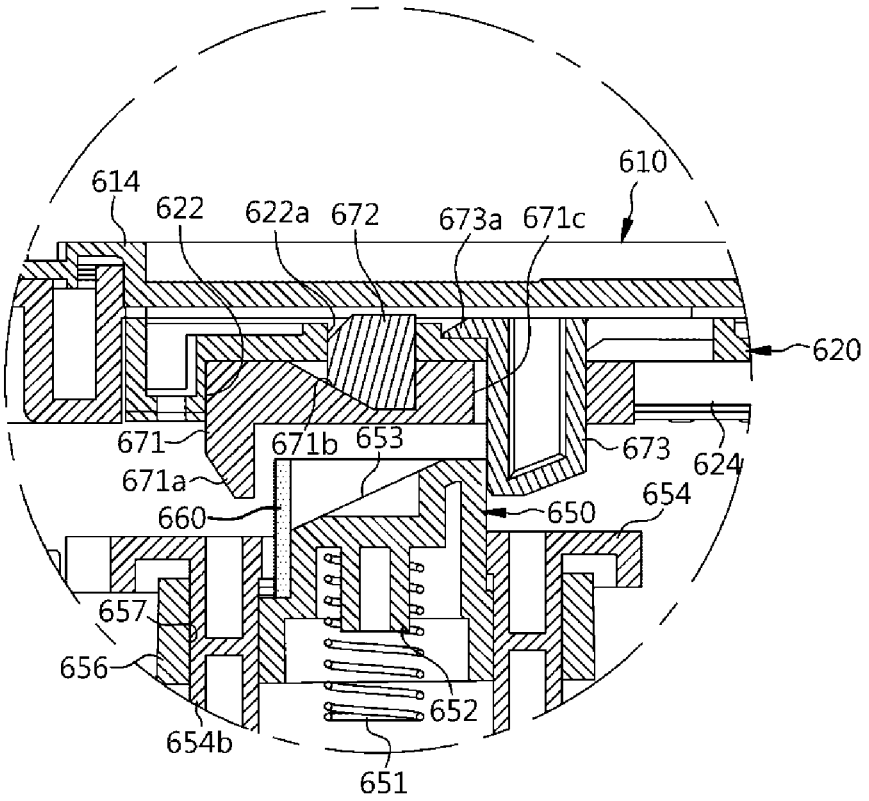
FIG. 27 is an enlarged view of an "E" portion of FIG. 26.

Hereinbelow, operation of the refrigerator according to the embodiment of the present disclosure will be described with respect to FIGS. 26 to 32. When the drawer 200 is not manipulated, the drawer 200 may be maintained in a closed state, as shown in FIGS. 26 and 27. While the drawer 200 is in the closed state and an input to open the drawer 200 is performed, power may be supplied to the driving part 400, and the driving motor 420 may operate. For example, the input to open the drawer 200 may include a user manipulation of a button 6 (e.g., a touching or pressing type button). Alternatively, a controller may control the drawer to open based on detecting a proximity of a user.

When the driving motor 420 is operated, the pinions 410 may be simultaneously rotated due to the driving force from the motor 420. The rack gears 611 and 621 of the rack gear assemblies 600 engaged with the opposite pinions 410 may be operated based on the rotation of the pinions 400, and the drawer 200 is moved forward.

After the first rack member 610 and the first rack cover 614 are first moved forward simultaneously, the second rack member 620 and the second rack cover 624 may be moved forward. While the first rack member 610 and the first rack cover 614 are moved forward simultaneously, the locking member 673 may be confined by the confining protrusion part 650. Accordingly, the second rack member 620 and the second rack cover 624 maintain initial positions thereof.

Figure 29:
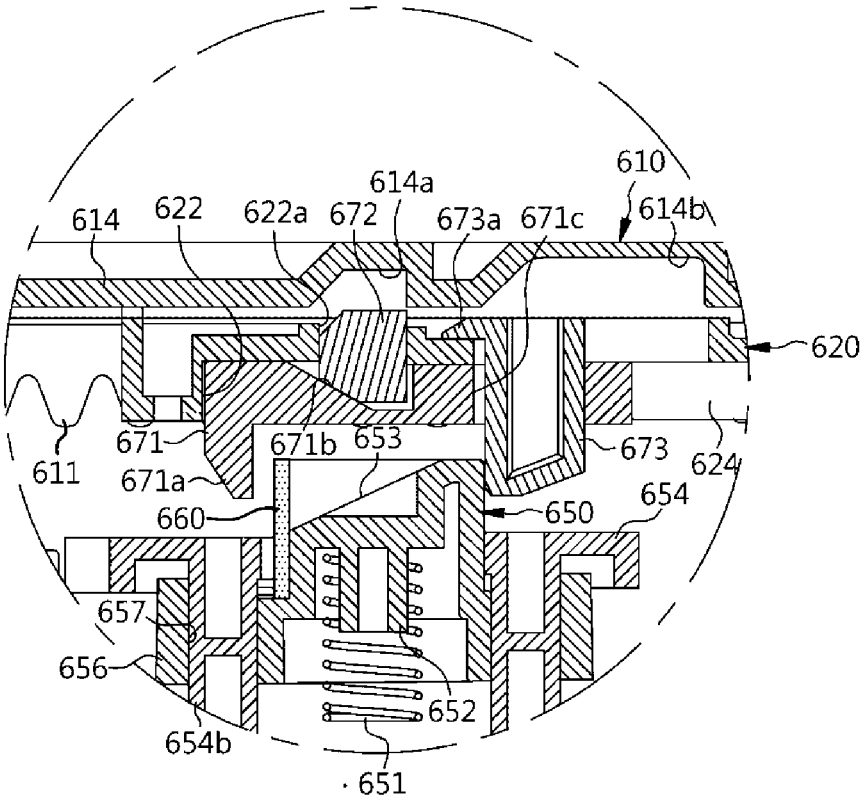
FIG. 29 is an enlarged view of an "F" portion of FIG. 28.

When the first rack member 610 and the first rack cover 614 are moved forward by a preset first distance and the linkage protrusion 681 comes into contact with the linkage step 682, the second rack member 620 and the second rack cover 624 may move forward together with the first rack member 610 from the contact of the linkage protrusion 681 with the linkage step 682, as shown in FIGS. 28 and 29.

Figure 30:
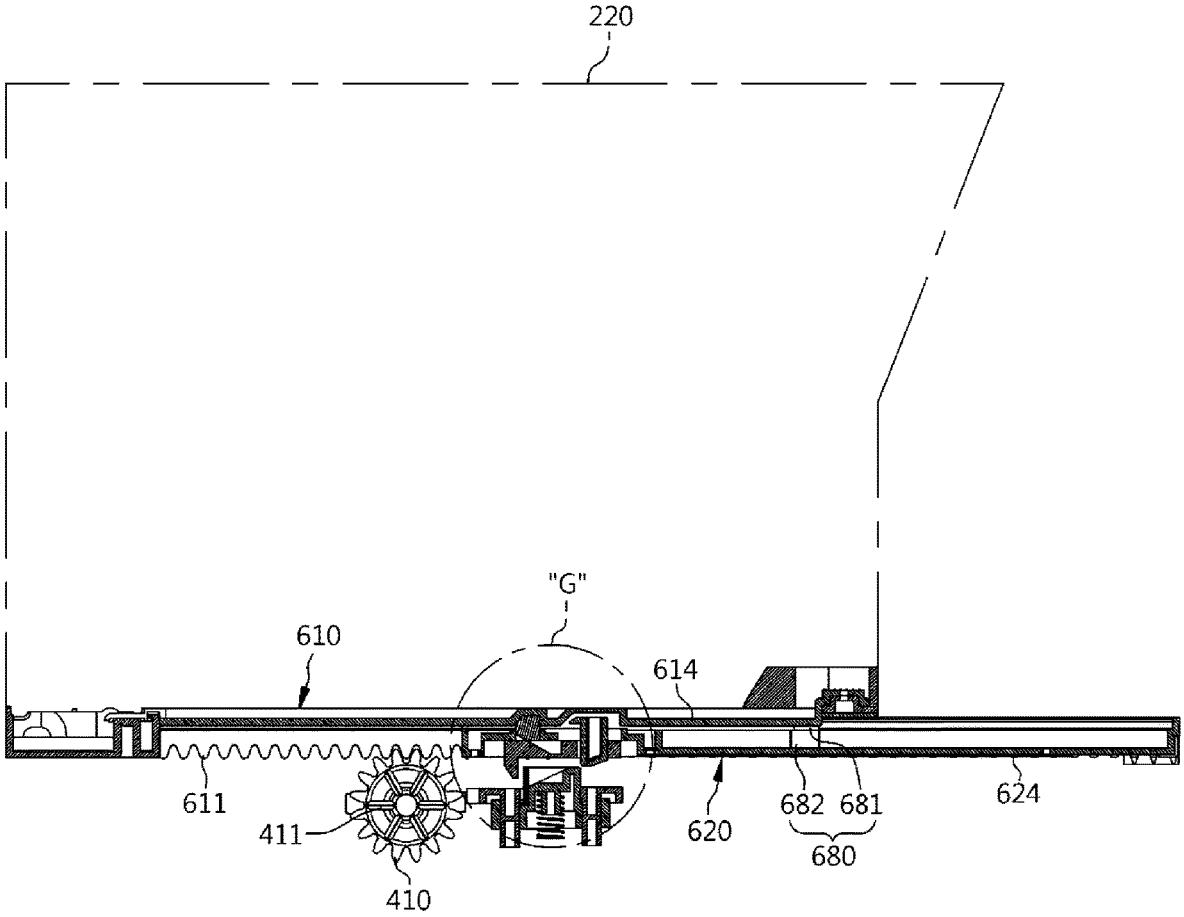
Figure 31:
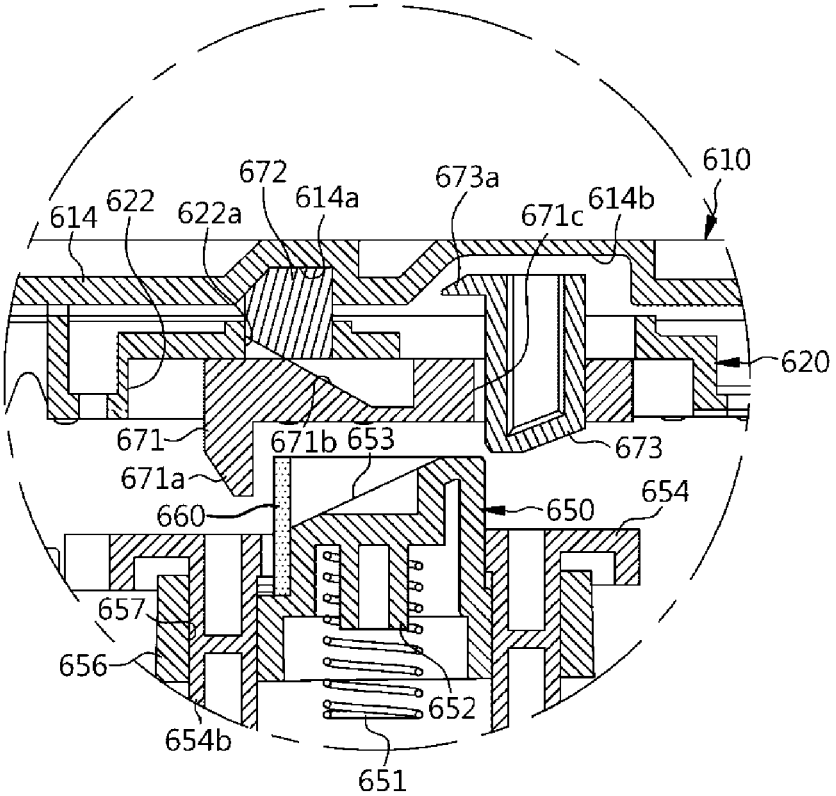
FIG. 31 is an enlarged view of a "G" portion of FIG. 30.

Since the locking member 673 is confined by the confining protrusion part 650, the stopper member 671 through which the locking member 673 passes maintains an initial position, and the second rack member 620 moves forward. As the extending step 673*a* of the locking member 673 gradually climbs on the lifting guide step 623 provided in the second rack member 620, the locking member 673 moves upward and moves away from the confining protrusion part 650, as shown in FIGS. 30 and 31.

As the stopper member 671 moves forward together with the second rack member 620 while the stopper member 671 contacts an inner rear surface of the motion groove 622, the stopper member 671 passes the confining protrusion part 650. This features is also illustrated in FIGS. 30 and 31.

Figure 32:
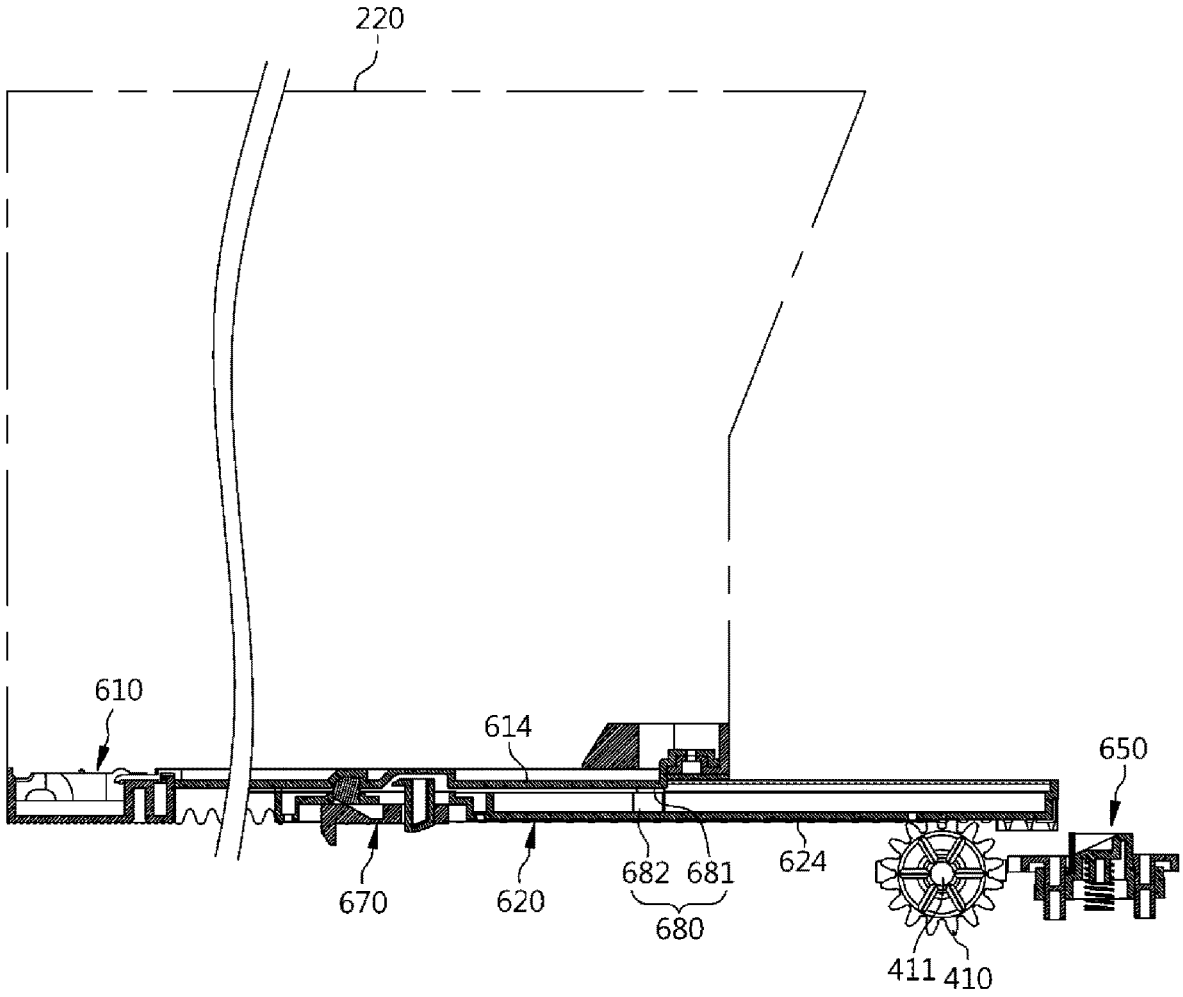

Subsequently, when the second rack member 620 and the second rack cover 624 move to follow the first rack member 610 and the first rack cover 614, the rack gear 621 of the second rack member 620 may engage the pinion 410 as the rack gear 611 of the first rack member 610 moves away from the pinion 410. When the rack gear 611 of the first rack member 610 moves away from the pinion 410 and the rack gear 621 of the second rack member 620 engages the pinion 410, the rack gear 621 receives a driving force from the pinion 410 so as to further move the drawer 200 forward, as shown in FIG. 32.

When the forward movement of the second rack member 620 is completed, as described above, the storage bin 220 of the drawer 200 may be positioned at a maximum open state. When a maximum open state of the storage bin 220 is detected (for example, detected by the open/close sensing part 514*a*, 514*b*), the lift module 300 may operate to move the container 240 in the storage bin 220 upward so that a user can efficiently take out the container 240 or items stored in the container 240 or store items into the container 240.

When an input to close the drawer 200 is received after the user has completed the use of the drawer 200, the driving motor 420 include in the driving part 400 operates and the pinion 410 may rotate in closing direction (e.g., counter-clockwise). Accordingly, the rack gear 621 of the second rack member 620 engaged with the pinion 410 operates and moves the second rack member 620 backward. The first rack member 610 may be pulled by the second rack member 620 due to the linkage part 680, and the first rack member 610 may move backward together with the second rack member 620.

When the front end of the rack gear 621 of the second rack member 620 is positioned to be engaged with the pinion 410, the rear end of the rack gear 611 of the first rack member 610 may also be positioned to engage the pinion 410. Subsequently, as the rack gear 621 of the second rack member 620 completes a rear movement and moves away from and no longer contacts the teeth of the pinion 410, and the first rack member 610 continues to move backward as the rack gear 611 engages the pinion 410.

For example, as described above, immediately before the second rack member 620 completely moves backward, the confining hook 671*a* of the stopper member 671 may engage the confining protrusion part 650 and does not move backward any further. While the stopper member 671 is blocked and the second rack member 620 additionally moves by a distance by which the stopper member 671 is provided to move in the motion groove 622, the extending step 673*a* of the locking member 673 is removed from the lifting guide step 623, and the locking member 673 moves downward.

When the second rack member 620 is prevented from moving further backward by the stopper member 671, the confining protrusion part 650 is positioned between the confining hook 671*a* of the stopper member 671 and the locking member 673 and engages to confine the second rack member 620. The first rack member 610 continues to move backward until the first rack member 610 returns to an initial position thereof (e.g., a position at which the storage bin is completely received). When completion of such a restoring movement is detected, the operation of the driving motor stops and the closing movement of the drawer stops.

Meanwhile, when the confining hook 671*a* of the stopper member 671 hits the confining protrusion part 650 and is blocked thereby while the above-mentioned closing movement of the drawer is performed, impact and impact noise occur due to the hitting. When speed of the backward movement of the drawer becomes faster, the impact and the resulting impact noise may also increase. When the noise reduction part 660 is provided on the flat portion 655 of the front surface of the confining protrusion part 650, the impact and the impact noise may be reduced or removed by the noise reduction part 660. Accordingly, damage to the components (e.g., the confining protrusion part 650 or the confining hook 671*a*) due to impact may be prevented and reliability may be improved while impact noise is reduced.

Accordingly, the refrigerator of the present disclosure includes the rack gear assembly 600 that is configured to extend sequentially such that the storage bin 220 of the drawer 200 may be completely opened. For example, the storage bin 220 may be configured to be opened and closed by being guided by a guide rail 230 provided at opposite sides thereof, and a lower part of the storage bin may be configured to be moved with the lower part supported by the rack gear assembly 600. Accordingly, although the storage bin may be heavy when storing items, an operation malfunction of the storage bin is prevented.

In addition, a noise reduction part 660 may be provided between a stopper member 671 and a confining protrusion part 650. Accordingly, although the stopper member 671 and the confining protrusion part 650 may collide with each other, impact noise may be reduced and damage caused by impact may be minimized. Additionally, he confining protrusion part 650 may elastically move upward and downward. Accordingly, although the locking member 673 may impact the confining protrusion part 650 during a backward movement of the second rack member 620, damage of the confining protrusion part 650 or the locking member 673 may be prevented.

In addition, the protrusion passing hole 513 may be provided on the bottom surface of the inner part of the lower storage chamber 3 to receive the confining protrusion part 650, and the confining protrusion part 650 is positioned in the protrusion passing hole 513 to ease maintenance of the confining protrusion part 650. Furthermore, the protrusion passing hole 513 may be provided in the cover plate 510 of the cable guide module 500. Accordingly, the cable guide module 500 and the confining protrusion part 650 may be assembled with each other.

Additionally, since an elastic member 651 may be provided in the protrusion passing hole 513 such that the confining protrusion part 650 is elastically moved upward and downward, the confining protrusion part 650 may be prevented from being damaged by hitting the locking member 673. In addition, the confining protrusion part 650 may have an open lower part, and the elastic member 651 may be positioned in the confining protrusion part 650. Accordingly, the confining protrusion part 650 is efficiently moved upward and downward.

In addition, since the elastic member 651 may be configured as the coil spring, assembling thereof may be relatively easy. Furthermore, since the spring engagement protrusion 652 may be provided on the upper surface of the inner part of the confining protrusion part 650 by protruding downward therefrom and the elastic member 651 may be combined with the spring engagement protrusion 652, the elastic member 651 is stably installed.

In addition, since the front surface of the confining protrusion part 650 may include flat portions 655, the confining hook 671*a* of the stopper member 671 may collides with the confining protrusion part 650 without slanting to a side (e.g., left to right).

Furthermore, since the noise reduction part 660 may be provided on the at least one surface of opposing contact surfaces of the confining hook and the confining protrusion part, the noise reduction part 660 is easily installed, removed, or replaced. Additionally, since the noise reduction part 660 may be made of a material having a cushioning effect, the noise reduction part may provide noise reduction and impact absorption. In addition, since the noise reduction part 660 is made of a rubber material, the noise reduction part 660 may provide improved noise reduction and impact absorption. Furthermore, since the noise reduction part 660 may be positioned to block a contact between the confining hook 671*a* and the confining protrusion part 650, the refrigerator may have improved impact absorption and noise reduction.

Additionally, since the fitting groove 657 may be provided in the confining protrusion part 650 by being recessed therefrom such that the noise reduction part 660 may be fitted into the fitting groove, the noise reduction part 660 may be easily inserted into the fitting groove 657 and or removed from the fitting groove 657 to be replaced. Furthermore, since the fitting groove 657 may have a trapezium structure that gradually extends in opposite sides thereof toward an inner part thereof, the fitting protrusion is prevented from being unintentionally removed from the fitting groove. In addition, since the fitting groove 657 may be open to the upper part of the confining protrusion part 650, the fitting protrusion 661 may be vertically fitted into and combined with the fitting groove, such that maintenance may be easily performed.

Additionally, a confining holder 654 is provided, to prevent deviation of the confining protrusion part 650 and to cover a gap between the protrusion passing hole 513 and the confining protrusion part 650. In addition, since the lift guide 654*b* may be provided on the lower surface of the confining holder 654, an exact vertical movement of the confining holder 654 is performed. Furthermore, since the lift guide 654*b* may be provided on each of opposite sides of the lower surface of the confining holder 654, the confining protrusion part 650 may be moved substantially vertically (e.g., upward and downward) without slanting.

Accordingly, certain aspects provide a refrigerator having a drawer with an opening distance that may be maximized such that items stored in a storage bin can be easily stored or taken out. In addition, certain aspects provide a type of refrigerator in which an impact noise occurring in when closing the drawer may be prevented. Furthermore, certain aspects provide a new type of refrigerator, wherein components provided to prevent impact noise occurring in the process of closing of the drawer are can be assembled and replaced. Additionally, the certain aspects provide a refrigerator in which impact mitigation performance of each of components provided to prevent impact noise occurring when closing a drawer is improved.

In order to achieve the and other aspect, a refrigerator may include a noise reduction part provided between a stopper member and a confining protrusion part. Accordingly, although the stopper member and the confining protrusion part collide with each other, impact noise is reduced and damage, which may be caused by impact, is prevented. Additionally, the confining protrusion part may be provided to elastically move upward and downward. Accordingly, although the locking member hits the confining protrusion part during a backward movement of a second rack member, damage of the confining protrusion part or the locking member may be prevented.

In addition, a protrusion passing hole may be provided on a bottom surface of an inner part of the storage chamber to receive the confining protrusion part, and the confining protrusion part may be positioned in the protrusion passing hole. Accordingly, maintenance of the confining protrusion part is easy. Furthermore, the protrusion passing hole may be provided in a cover plate of the cable guide module. Accordingly, the cable guide module and the confining protrusion part are assembled with each other.

Additionally, an elastic member may be provided in the protrusion passing hole such that the confining protrusion part is elastically moved upward and downward so that the confining protrusion part may be prevented from being damaged by hitting the locking member. In addition, the confining protrusion part may be provided as a body having an open lower part, and the elastic member may be positioned in the confining protrusion part so that the confining protrusion part may be efficiently moved upward and downward.

Furthermore, the elastic member may be provided as a coil spring. Accordingly, manufacturing thereof may be easy. Additionally, a spring engagement protrusion may be provided on an upper surface of an inner part of the confining protrusion part by protruding downward therefrom, and the elastic member may be engaged with the spring engagement protrusion to allow the elastic member to be stably installed.

In addition, a front surface of the confining protrusion part may be provided to have flat portions so that a confining hook of the stopper member may exactly collide with the confining protrusion part without slanting left to right. Furthermore, the noise reduction part may be provided on at least one surface of opposing contact surfaces of the confining hook and the confining protrusion part so that the noise reduction part may be easily installed, removed, or replaced. In addition, the noise reduction part may be made of a material having a cushioning effect so that the noise reduction part may advantageously reduce reduction and absorb impact. In addition, the noise reduction part may be made of a rubber material to improve noise reduction and impact absorption.

Furthermore, according to the refrigerator of the present invention, the noise reduction part may be configured to block a contact between the confining hook and the confining protrusion part to improve impact absorption and noise reduction. Additionally, a fitting groove may be configured on the confining protrusion part by being recessed therefrom such that the noise reduction part is fitted into the fitting groove such that the noise reduction part may be easily assembled and replaced.

In addition, the fitting groove may be configured to have a trapezium structure gradually extending to opposite sides thereof toward an inner part thereof so that the noise reduction part may be prevented from being unintentionally removed from the fitting groove. Furthermore, the fitting groove may be configured to be open to an upper end of the confining protrusion part so that a fitting protrusion may be vertically fitted into and combined with the fitting groove.

Additionally, a confining holder may be provided, preventing deviation of the confining protrusion part and covering a gap between the protrusion passing hole and the confining protrusion part. In addition, a lift guide may be provided on a lower surface of the confining holder so that an exact vertical movement of the confining holder may be performed. Furthermore, the lift guide may be provided on each of opposite sides of the lower surface of the confining holder so that the confining protrusion part may be exactly vertically moved upward and downward without slanting.

As described above, according to the refrigerator of the present invention, the storage bin constituting the drawer may be completely moved forward by the rack gear assembly configured to extend sequentially. Particularly, the storage bin is configured to be guided and moved forward by a guide rail at opposite sides thereof, and a lower part of the storage bin is moved while being supported by the rack gear assembly. Accordingly, although the storage bin is heavy, operation malfunction of the storage bin is prevented.

In addition, the noise reduction part is provided between a stopper member and a confining protrusion part. Accordingly, although the stopper member and the confining protrusion part collide with each other, impact noise is reduced and damage, which may be caused by impact, is prevented. Additionally, the confining protrusion part may be provided to elastically move upward and downward so that even if the locking member hits the confining protrusion part during the backward movement of the second rack member, damage of the confining protrusion part or the locking member may be prevented.

In addition, the protrusion passing hole is provided on a bottom surface of an inner part of the storage chamber to receive the confining protrusion part, and the confining protrusion part is positioned in the protrusion passing hole, so that ease of maintenance of the confining protrusion part may improve. Furthermore, the protrusion passing hole may be provided in a cover plate of the cable guide module to allow the cable guide module and the confining protrusion part to be assembled with each other.

Additionally, an elastic member is provided in the protrusion passing hole such that the confining protrusion part is elastically moved upward and downward, so the confining protrusion part is prevented from being damaged by hitting the locking member. In addition, the confining protrusion part is provided as a body having the open lower part, and the elastic member may be positioned in the confining protrusion part, so the confining protrusion part is efficiently moved upward and downward.

Furthermore, the elastic member is provided as a coil spring. Additionally, the spring engagement protrusion is provided on the upper surface of the inner part of the confining protrusion part by protruding downward therefrom, and the elastic member may engaged the spring engagement protrusion, so that the elastic member may be stably installed.

In addition, the front surface of the confining protrusion part is provided to have flat portions, so the confining hook of the stopper member exactly collides with the confining protrusion part without slanting left to right. Furthermore, the noise reduction part is provided on the at least one surface of opposing contact surfaces of the confining hook and the confining protrusion part, so the noise reduction part may be easily installed, removed, or replaced. In addition, the noise reduction part is made of a material having a cushioning effect, so the noise reduction part improves noise reduction and impact absorption.

Furthermore, the noise reduction part is made of a rubber material, so the noise reduction part is advantageous in noise reduction and impact absorption. Furthermore, the noise reduction part is configured to block the contact portion between the confining hook and the confining protrusion part, so the refrigerator is advantageous in impact absorption and noise reduction.

Additionally, the fitting groove is configured on the confining protrusion part by being recessed therefrom such that the noise reduction part is fitted into the fitting groove, so the noise reduction part is easily assembled and replaced. In addition, the fitting groove may have a trapezium structure gradually extending to opposite sides thereof toward an inner part thereof, so the noise reduction part is prevented from being unintentionally removed from the fitting groove. In addition, the fitting groove is configured to be open to an upper part of the confining protrusion part, and the fitting protrusion is vertically fitted into and combined with the fitting groove.

Additionally, a confining holder is provided, preventing deviation of the confining protrusion part and covering the gap between the protrusion passing hole and the confining protrusion part. In addition, the lift guide is provided on the lower surface of the confining holder, so an exact vertical movement of the confining holder is performed. Furthermore, the lift guide may be provided on each of opposite sides of the lower surface of the confining holder, so that the confining protrusion part is exactly moved upward and downward without slanting.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

This application is also related to U.S. application Ser. No. 16/583,726 filed Sep. 26, 2019, U.S. application Ser. No. 16/582,647 filed Sep. 25, 2019, U.S. application Ser. No. 16/582,518 filed Sep. 25, 2019, U.S. application Ser. No. 16/582,605 filed Sep. 25, 2019, U.S. application Ser. No. 16/582,712 filed Sep. 25, 2019, U.S. application Ser. No. 16/582,756 filed Sep. 25, 2019, U.S. application Ser. No. 16/582,668 filed Sep. 25, 2019, U.S. application Ser. No. 16/582,755 filed Sep. 25, 2019, U.S. application Ser. No. 16/582,831 filed Sep. 25, 2019, U.S. application Ser. No. 16/585,284 filed Sep. 27, 2019, U.S. application Ser. No. 16/585,301 filed Sep. 27, 2019, and U.S. application Ser. No. 16/585,816 filed Sep. 27, 2019, whose entire disclosures are also hereby incorporated by reference.

What is claimed is:

1. A refrigerator comprising:

a cabinet having an opening to access a storage chamber provided within the cabinet;

a drawer including a front panel and a storage bin coupled to a rear of the front panel, the drawer being coupled to the cabinet such that drawer moves between a first position in which the front panel closes the opening of the cabinet and the storage bin is received in the storage chamber, and a second position in which the front panel is spaced away from the opening of the cabinet and at least a portion of the storage bin is positioned outside of the storage chamber;

a pinion positioned at a lower surface the storage chamber of the cabinet; and a rack gear assembly coupled to the storage bin such that the drawer is moved based on a rotation of the pinion, wherein the rack gear assembly includes:

a first rack having a first rack gear and a second rack having a second rack gear, the first rack gear and the second rack gear engaging the pinion;

a protrusion provided in the storage chamber;

a stopper frame provided in the second rack and including an extension that contacts the protrusion to limit a backward movement of the second rack; and a pad positioned in a contact area between the stopper frame and the protrusion.

2. The refrigerator of claim 1, wherein the protrusion protrudes upward from the lower surface of the storage chamber of the cabinet, and the extension of the stopper frame includes a confining hook that contacts a front surface of the protrusion when the second rack travels a prescribed distance backwards.

3. The refrigerator of claim 2, wherein a hole is provided at the lower surface of the storage chamber of the cabinet, and the protrusion extends through the hole at the lower surface of the storage chamber such that an upper portion of the protrusion is exposed to an interior of the storage chamber.

4. The refrigerator of claim 3, wherein a cavity is formed on the lower surface of the storage chamber of the cabinet, the cavity being at least partially covered by a cover plate, and the hole at the lower surface of storage chamber of the cabinet is formed in the cover plate.

5. The refrigerator of claim 3, wherein an elastic member is provided in the hole such that the protrusion is configured to move upward or downward.

6. The refrigerator of claim 5, wherein the protrusion is a body having a closed upper surface and an open lower end, and the elastic member passes through the open lower end of the protrusion such that a portion of the elastic member is received within the protrusion.

7. The refrigerator of claim 6, wherein the elastic member is a coil spring.

8. The refrigerator of claim 6, wherein a spring engagement protrusion is provided in an interior of the protrusion, and an upper end of the elastic member is coupled to the spring engagement protrusion.

9. The refrigerator of claim 6, wherein a front surface of the protrusion is configured to have a flat region, and the confining hook of the stopper frame contacts the flat portions to limit a movement of the stopper frame.

10. The refrigerator of claim 3, wherein a width of the hole at the lower surface of the storage chamber is larger than an outer width of the protrusion, a combination end protrudes from an outer surface of the protrusion, and a confining plate is provided on the lower surface of the storage chamber of the cabinet, the confining plate having a protrusion through hole through which the protrusion passes and being positioned to cover a gap between the protrusion and the hole at the lower surface of the storage chamber.

11. The refrigerator of claim 10, wherein a guide boss is provided on a lower surface of the confining plate, the guide boss guiding a vertical movement of the combination end of the protrusion.

12. The refrigerator of claim 11, wherein the combination end is provided on opposite sides of the protrusion, and a plurality of the guide bosses are provided on the lower surface of the confining plate to face the opposite sides of the protrusion.

13. The refrigerator of claim 2, wherein the pad is provided on at least one of the confining hook or the protrusion.

14. The refrigerator of claim 13, wherein the pad is made of a cushioning material.

15. The refrigerator of claim 13, wherein the pad is made of a rubber material.

16. The refrigerator of claim 13, wherein the pad is provided on the confining hook of the stopper frame and covers a surface of the confining hook that contacts the protrusion when the second rack travels the prescribed distance backwards.

17. The refrigerator of claim 13, wherein the pad is provided on the protrusion and covers a surface of the protrusion that contacts the stopper frame when the second rack travels the prescribed distance backwards.

18. The refrigerator of claim 17, wherein a fitting groove is provided on the surface of the protrusion, and a fitting protrusion is provided on the pad and is configured to be fitted into the fitting groove.

19. The refrigerator of claim 18, wherein the fitting groove has a trapezium structure and gradually extends to opposite sides thereof.

20. The refrigerator of claim 18, wherein the fitting groove is configured to be open at an upper end of the protrusion, and the fitting protrusion is configured to be vertically fitted into the fitting groove.

* * * * *